US009865239B1

(12) United States Patent
White

(10) Patent No.: US 9,865,239 B1
(45) Date of Patent: Jan. 9, 2018

(54) GUITAR COMPONENT ATTACHMENT SYSTEM

(71) Applicant: Timothy P. White, New Boston, NH (US)

(72) Inventor: Timothy P. White, New Boston, NH (US)

( * ) Notice: Subject to any disclaimer, the term of this patent is extended or adjusted under 35 U.S.C. 154(b) by 0 days.

(21) Appl. No.: 15/483,713

(22) Filed: Apr. 10, 2017

Related U.S. Application Data

(63) Continuation-in-part of application No. 15/153,343, filed on May 12, 2016, now Pat. No. 9,620,098.

(51) Int. Cl.
*G10D 3/00* (2006.01)
*G10G 7/00* (2006.01)
*G10H 3/18* (2006.01)

(52) U.S. Cl.
CPC ..... *G10G 7/00* (2013.01); *G10H 3/186* (2013.01); *G10H 2220/015* (2013.01)

(58) Field of Classification Search
CPC ..... G10H 3/186; G10H 2230/015; G10H 2230/365
USPC ..... 84/743, 329
See application file for complete search history.

(56) References Cited

U.S. PATENT DOCUMENTS 4,785,708 A * 11/1988 Vaughan ..... G10D 3/163 84/322
4,899,636 A * 2/1990 Chiba ..... B06B 1/06 381/114
7,638,698 B1 * 12/2009 Bellissimo ..... G10D 7/123 84/327
8,173,881 B1 * 5/2012 Schenk ..... G10D 1/005 84/312 R
9,240,170 B2 * 1/2016 Chekardzhikov ..... G10G 7/02
9,620,098 B2 * 4/2017 White ..... G10H 3/186
2014/0224099 A1 * 8/2014 Webman ..... G10H 3/18 84/630
2015/0082970 A1 * 3/2015 Chekardzhikov ..... G10G 7/02 84/455
2015/0356960 A1 * 12/2015 Webman ..... G10H 3/18 84/630
2016/0183393 A1 * 6/2016 Groom ..... A45C 11/00 280/33.992
2016/0335997 A1 * 11/2016 White ..... G10H 3/186

* cited by examiner

*Primary Examiner* — Jeffrey Donels
(74) *Attorney, Agent, or Firm* — Luis Figarella

(57) ABSTRACT

A first ferromagnetic piece of metal is attached to the inside surface of a stringed musical instrument such as an acoustic guitar, allowing an external magnetic mount to be attached to the musical instrument through the magnetic force of the magnetic mounts magnet on the first ferromagnetic piece of metal. One or more electronic device equipped with one or more ferromagnetic elements trapped, sandwiched, mounted on or made part of the device and/or a device protective case may then be softly, removably and firmly mounted to the outer surface of the instrument without chemically adhering to or disturbing the outer surface of the instrument through magnetic attachment to the magnetic mount. The inner-mounted ferromagnetic element may be attached permanently or removably to the inner surface of the instrument, so that the external magnetic mount may have its position adjusted for optimizing the position of the externally mounted device.

15 Claims, 41 Drawing Sheets

6 a.
6 b.
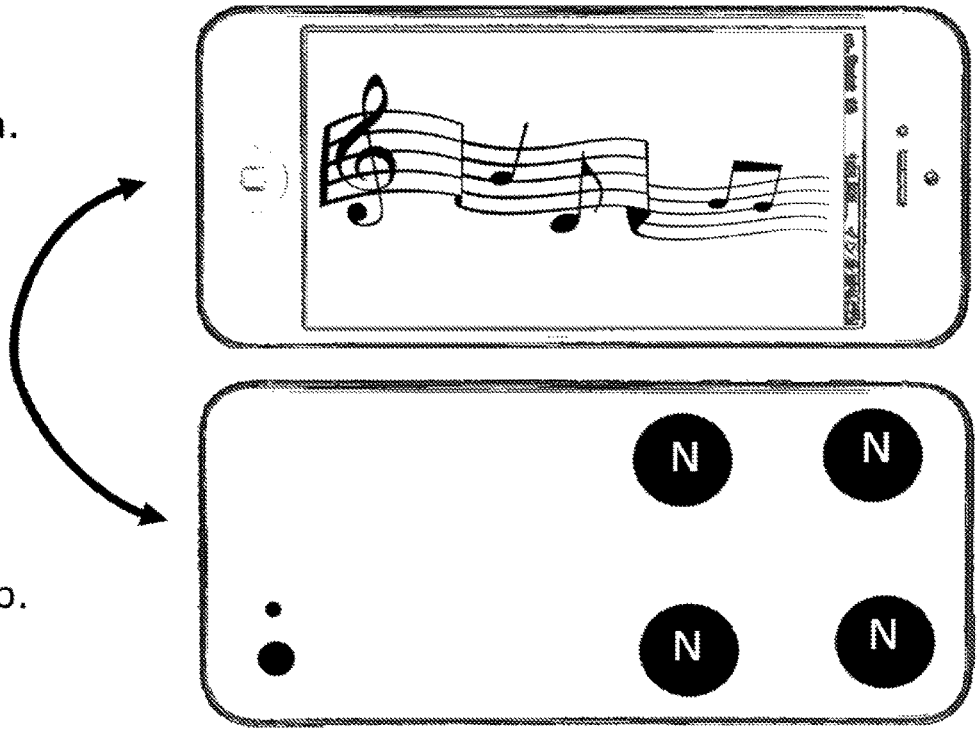
Figures 6A, 6B, 6C
6 c.
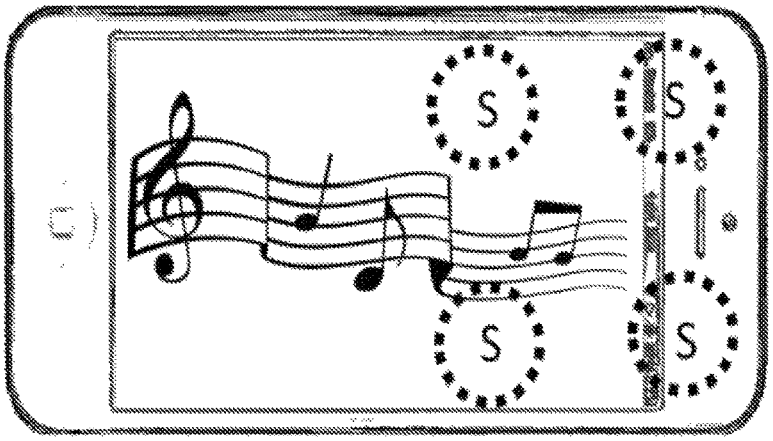

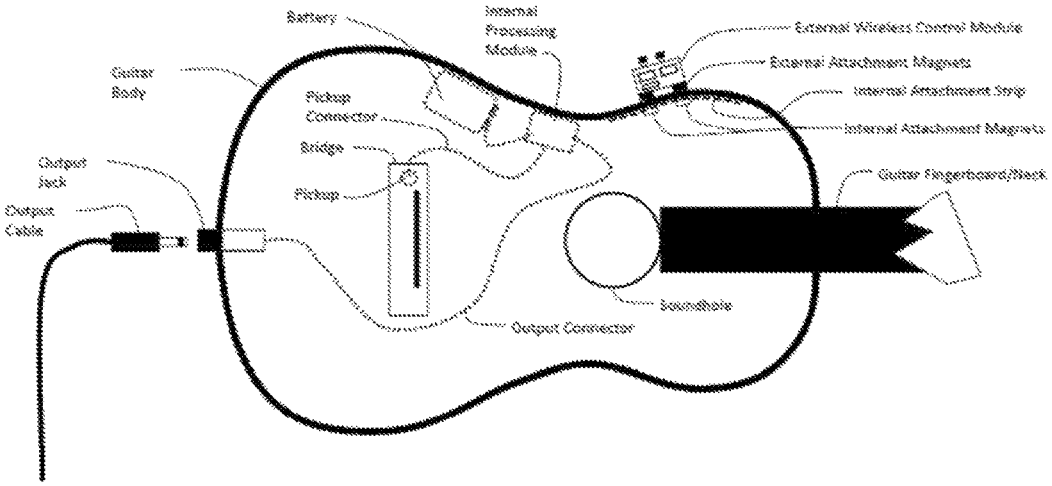
Figure 8
Replacement Sheet

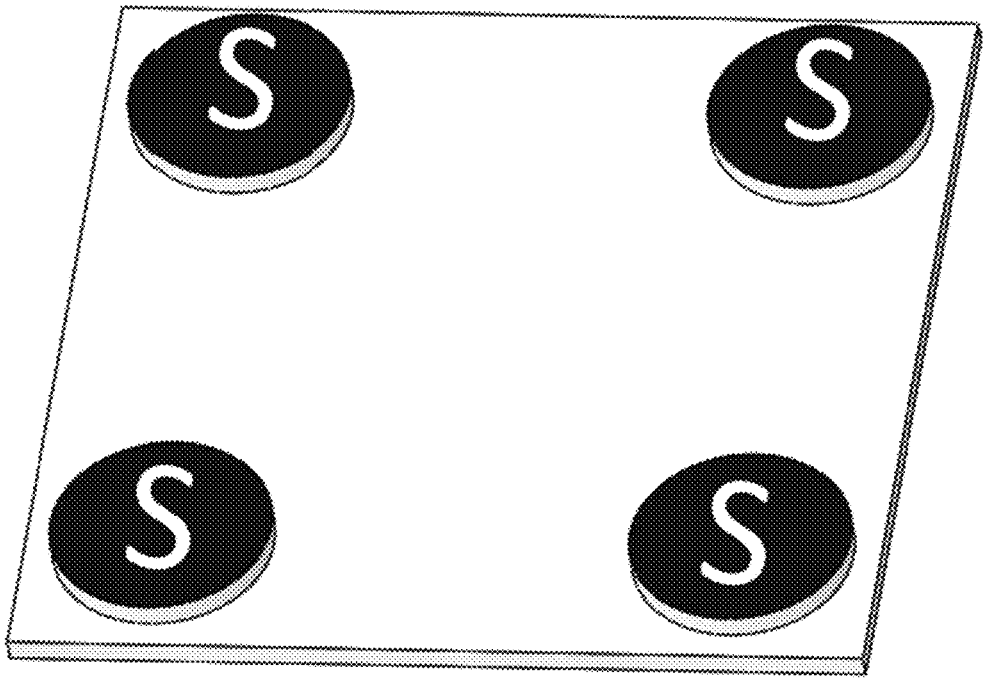
Figure 15
Figure 16
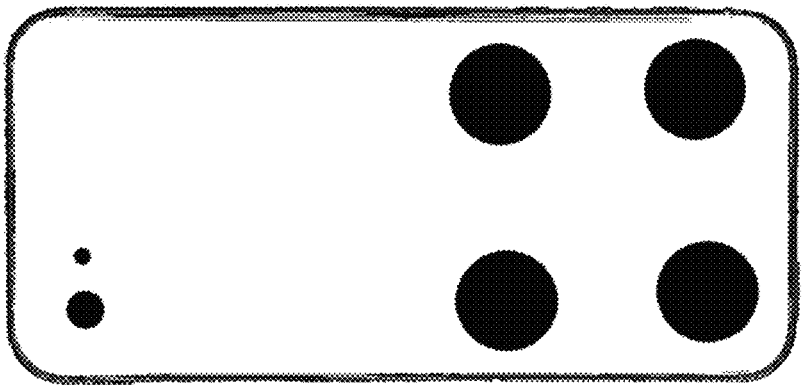

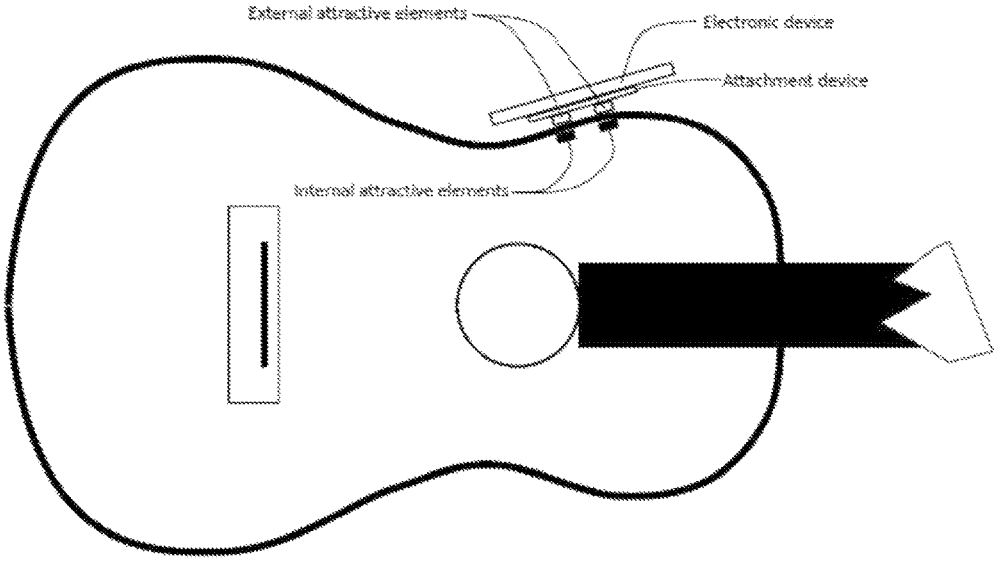
Figure 20
Figure 21
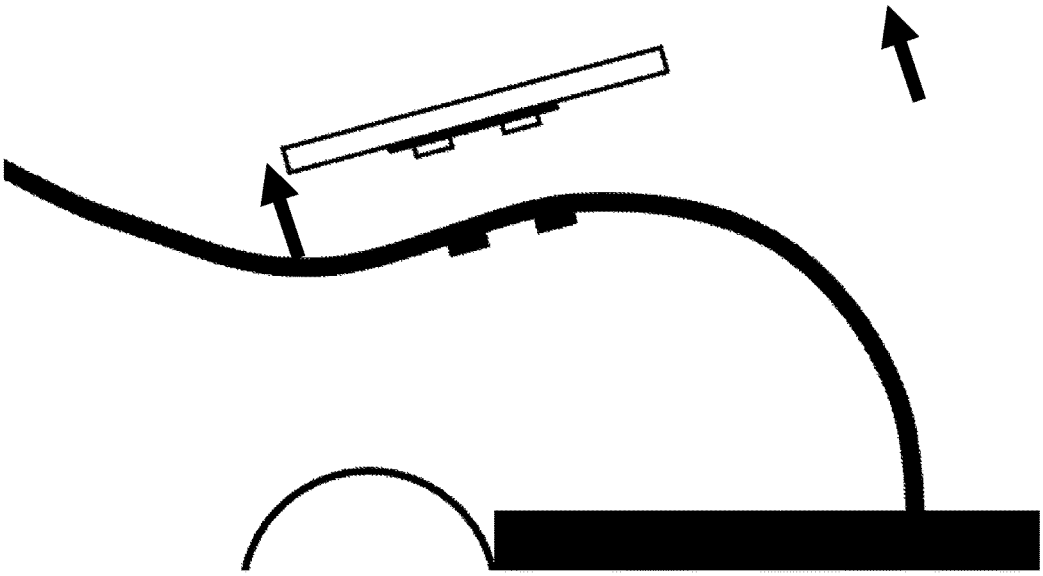

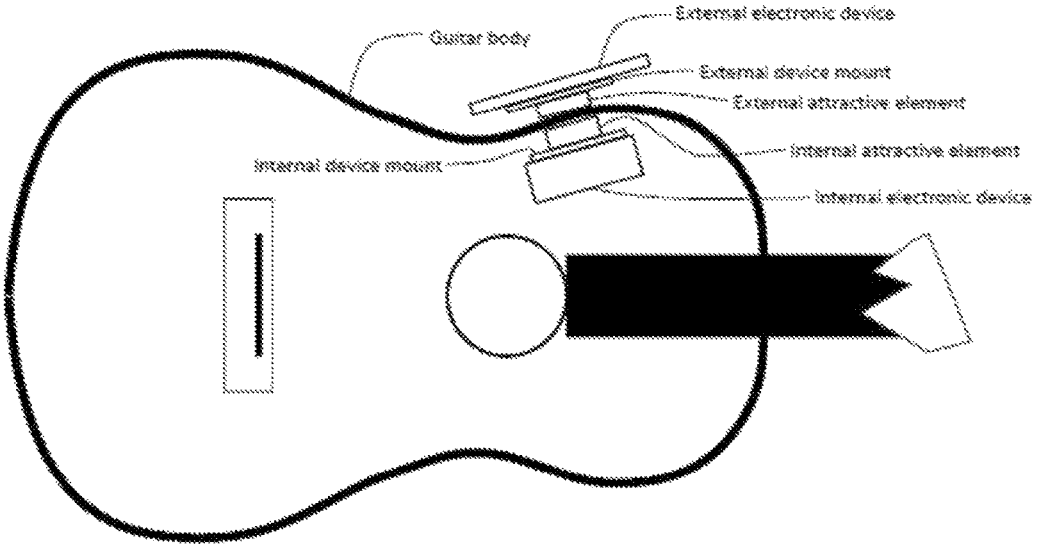
Figure 22
Figure 23
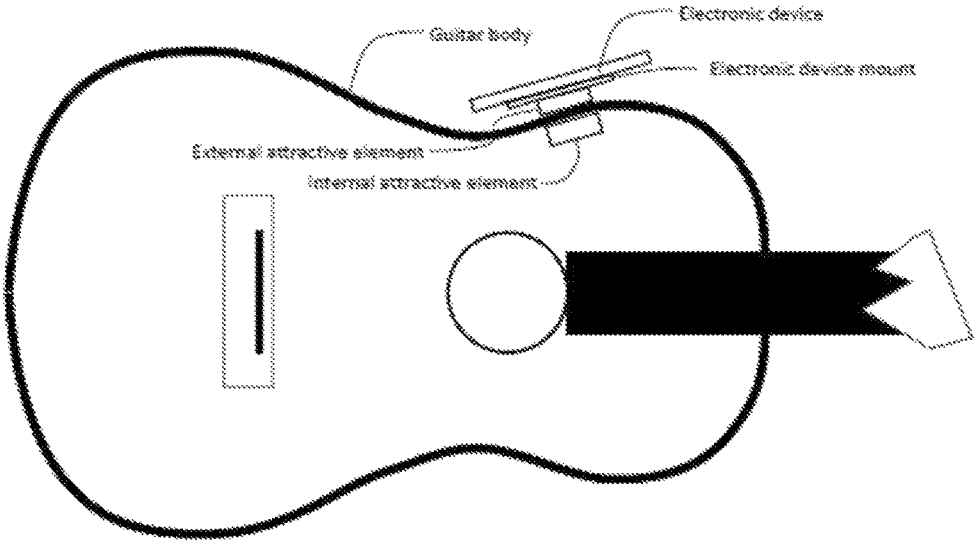

GUITAR COMPONENT ATTACHMENT SYSTEM

CROSS-REFERENCE TO RELATED APPLICATIONS

This application is a continuation in part of pending U.S. patent application Ser. No. 15/153,343 titled "Guitar Component Attachment System", filed on May 12, 2016 the disclosure of which is herein incorporated by reference in its entirety.

PATENTS CITED

The following documents and references are incorporated by reference in their entirety, Webman (U.S. Pat. Appl. No. 2014/0224099), White (U.S. Pat. Nos. 4,573,391; 5,945,614; 6,188,005), Jennings et al (U.S. Pat. No. 4,058,045), Donnell (U.S. Pat. Nos. 5,010,803 and 5,614,688), Gillete (U.S. Pat. Appl. No. 2009/0064853) and DeMars (U.S. Pat. Appl. No. 2008/0173165).

FIELD OF THE INVENTION

The present invention relates to an electronic control and communication system and method for musical instruments, as well as to a system and method for mounting external elements to a musical instrument without adversely affecting its sound and acoustic properties, or disturbing its surface or surface finish.

DESCRIPTION OF THE RELATED ART

It is common for an acoustic guitar to have a pickup attached to it so that it can be amplified. Different types of pickups can be used, the most common types being piezo-electric and magnetic. Magnetic pickups for acoustic guitars are commonly mounted in the vicinity of the sound hole under the vibrating strings, and have an output voltage large enough to be output directly to an external amplifier.

Piezo-electric pickups are typically attached to the underside of the soundboard of the guitar or within the bridge's saddle slot, and have a relatively weak signal requiring pre-amplification before being output to the external amplifier. It is useful for an acoustic guitarist to be able to control the volume and tone quality of their instrument.

It is common for some acoustic guitars to have a volume and tone control module built into the side of the upper bout facing and easily accessed by the player, such control modules also typically having a replaceable battery compartment accessible from the outside. Prior art tone and volume control modules for new acoustic guitars are typically mounted in a hole cut into the side of the upper bout of the instrument.

For an acoustic guitar without a control module to be fitted with one requires a mounting hole to be cut into the side of the upper bout of the instrument. Many owners of fine guitars would rather do without a control module than cut a mounting hole for one in their guitar. The present invention provides for an acoustic guitar not equipped with a control module to have one installed at the nominal location on the side of the upper bout of the instrument, but without requiring that a mounting hole be cut in the instrument, or having the surface of the instrument be disturbed in any way, for example with an adhesive.

The present invention further provides for the guitar control module to be attached in such a way as to be instantly removable or repositioned. The present invention further provides for the guitar control module to be programmable, so that it may control not only the volume and tone of the guitar, but other attributes and functions as well, including 2-way communication between arbitrary sensors, internal and external electronic devices and external control devices. The present invention further provides that the guitar's external control module consists of a smart phone, such as an iPhone.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

An electronic control and communication module is removably attached to the outer surface of a guitar by means of magnetic attraction between ferromagnetic metal or magnetic "feet" attached to the underside of the external control module and opposed magnets or ferromagnetic metal "anchors" mounted on the inside of the guitar. The external control module incorporates typical musician-controlled interface devices such as knobs and sliders for controlling volume and tone and similar musical attributes.

The external control module also incorporates an electronic processor, power supply and a wireless communication device enabling it to communicate with a separate processing module mounted elsewhere on, within or in the vicinity of the guitar. The external control module enables the musician to control various guitar functions as well as communicate with arbitrary communication-enabled internal and external devices including sensors, controllers and actuators.

In one aspect the invention is about a removable magnetic attachment mechanism for attaching at least one device to the external surface of a musical instrument such as a guitar, whereby said attachment mechanism comprises a magnetically attractive element device attachment mechanism using magnetic attractive force to simultaneously attract at least one magnetically attractive element comprised of at least one magnet, wherein said magnetically attractive element has at least one non-marring surface where it makes contact with the outer surface finish of the musical instrument and a first ferromagnetic strip configured to be removably attached at one or more points along an axial direction of a strip attachment material mounted to the inner surface of said musical instrument. In another aspect, a second ferromagnetic strip configured to allow attachment to said magnetically attractive element surface, wherein said strip of material mounted inside said musical instrument is comprised of hooks-and-loops and said first ferromagnetic strip has a complementary portion of hooks-and-loops material permanently attached to said first ferromagnetic strip's surface. In yet another aspect said magnetically attractive element has at least one surface curved to approximately match at least one curved surface on said instrument's surface.

In another aspect said magnetically attractive element has at least one magnet shaped to match the curve of said device curved surface. In yet another aspect said magnetically attractive element has at least one deformable pad along at least one said attractive element's surface. In another aspect said second ferromagnetic strip is part of a device case. In yet another aspect, said magnetically attractive element has at least one deformable pad along at least one of said attractive element's surface. In another aspect, said magnetically attractive element has at least one deformable pad along at least one attractive element surface. In yet another aspect said second ferromagnetic strip is part of a device case.

In another aspect a second ferromagnetic strip configured to allow attachment to said magnetically attractive element surface, wherein said strip of material mounted inside said musical instrument is comprised of one or more bendable inner ferromagnetic strip with thickness between 0.1 mm and 2 mm thick allowing it to be shaped by hand to match the curvature of the inner attachment surface. In yet another aspect said strip of material has a complementary portion of hooks-and-loops material permanently attached to said first ferromagnetic strip's surface. In yet another aspect said strip of material has one or more chemical bonding elements for permanent attached to said instrument's inner surface.

Other features and advantages of the present invention will become apparent upon examining the following detailed description of an embodiment thereof, taken in conjunction with the attached drawings.

BRIEF DESCRIPTION OF THE DRAWINGS

FIGS. 6A, 6B and 6C show electronics displays and magnet mounting configurations for external electronic devices attached to a guitar body, according to exemplary embodiments of the invention.

FIG. 8 shows an external electronic device attached to a guitar body with an additional output cable, according to exemplary embodiments of the invention.

FIG. 15 shows the one polarity (North or South) magnets on the inside plate, according to exemplary embodiments of the invention.

FIG. 16 shows the complementary polarity (South or North) magnets on the iPhone, according to exemplary embodiments of the invention.

FIG. 20 shows an external electronic device attached to a guitar body, according to exemplary embodiments of the invention.

FIG. 21 shows details of the external electronic device attached to a guitar body, according to exemplary embodiments of the invention.

FIG. 22 shows an external electronic device attached to a guitar body, according to exemplary embodiments of the invention.

FIG. 23 shows the details of the electronic device attached to a guitar body, according to exemplary embodiments of the invention.

Figure 1:
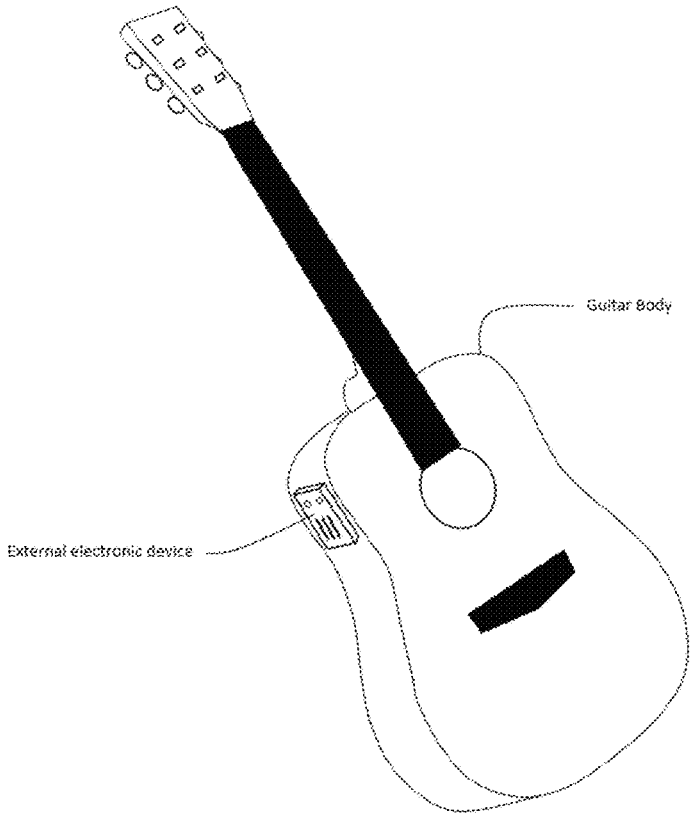
FIG. 1 shows an external electronic device attached to a guitar body, according to exemplary embodiments of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Referring to FIGS. 1-18, we see an exemplary embodiment of the invention which comprises a magnetic attachment mechanism for a stringed musical instrument such as a guitar, whereby an electronic device is magnetically attached to the outside surface of the instrument by magnetic attraction to one or more magnetic elements inside the instrument.

The external electronic device is attached to a mount that is equipped with one or more magnetically attractive elements or "feet" which are attracted to oppositely located magnetically attractive elements or "anchors" mounted on the inner surface of the instrument.

The attachment mechanism can comprise several different arrangements of magnetic attachment parts, and may be mounted through internal magnetic mount module, either permanently or removably attached. For example, the external electronic device can be equipped with one or more magnet "feet" being attracted through the side wall to one or more magnet "anchors" mounted on the opposite inside surface of the guitar body, providing the strongest possible attachment.

Alternatively, the magnet "feet" on the external device mount can be substituted with one or more pieces of ferromagnetic metal, which are attracted to the internally mounted magnets. Alternatively, the one or more magnets mounted on the inner surface can be substituted by one or more ferromagnetic metal feet, which are attracted to the mounting magnets of the external electronic device.

The attachment surface of the external magnets or metal pieces are coated with a soft material, for example rubber or cork, to prevent marring of the guitar's finish. The external device mount can be configured to hold arbitrary electronic devices on the instrument, for example a smart phone. FIG. 1 shows a typical acoustic guitar equipped with an external electronic control module.

Figure 2:
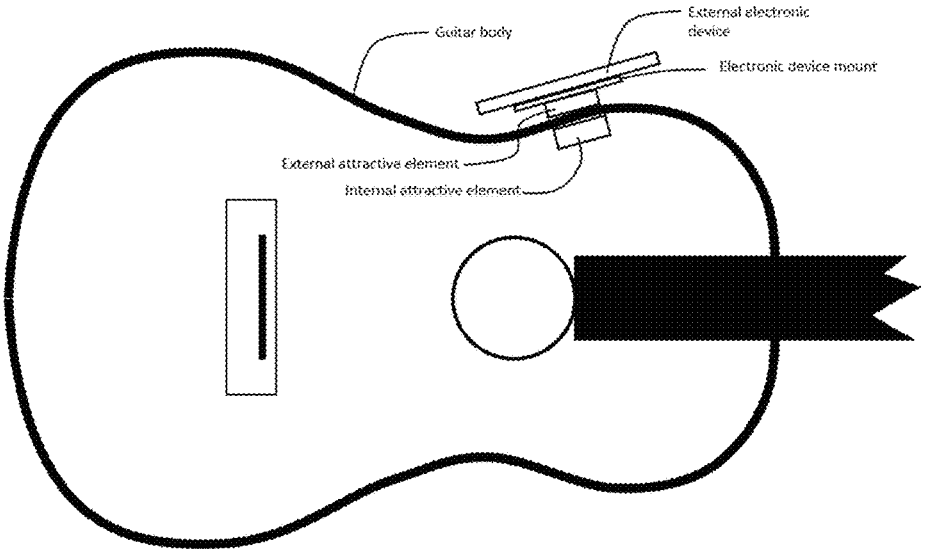
FIG. 2 shows an external electronic device attached to a guitar body, according to exemplary embodiments of the invention.

FIG. 2 shows a schematic transparent plan view of the guitar body including the invention magnetic device attachment mechanism. Inside the guitar is a magnetically attractive element, which may or may not be bonded to the inner wall. The outer attractive element is attracted to the internal element strongly enough to hold it firmly in place against the outer surface of the guitar. The outer attractive element has attached to it a mounting device for attaching an external electronic control device.

Figure 3:
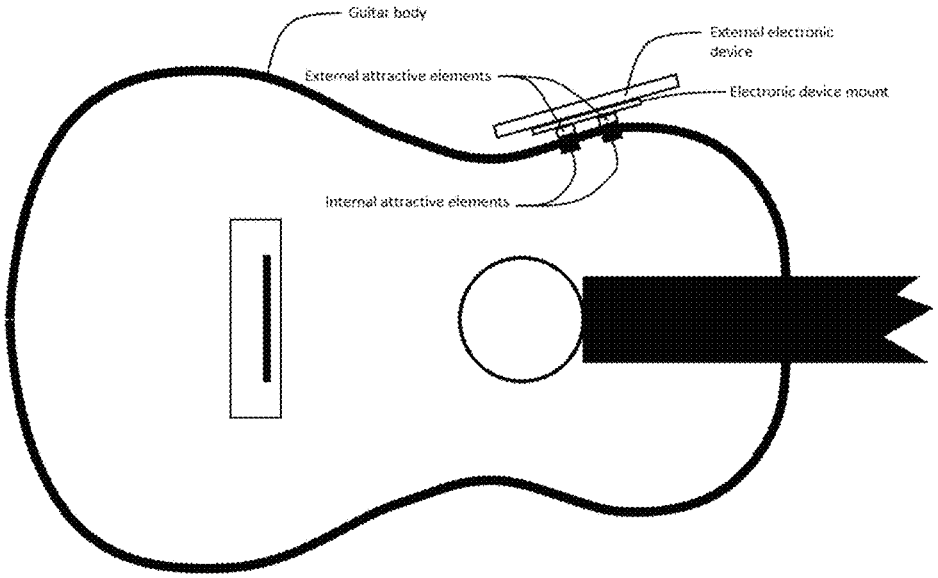
Figure 4:
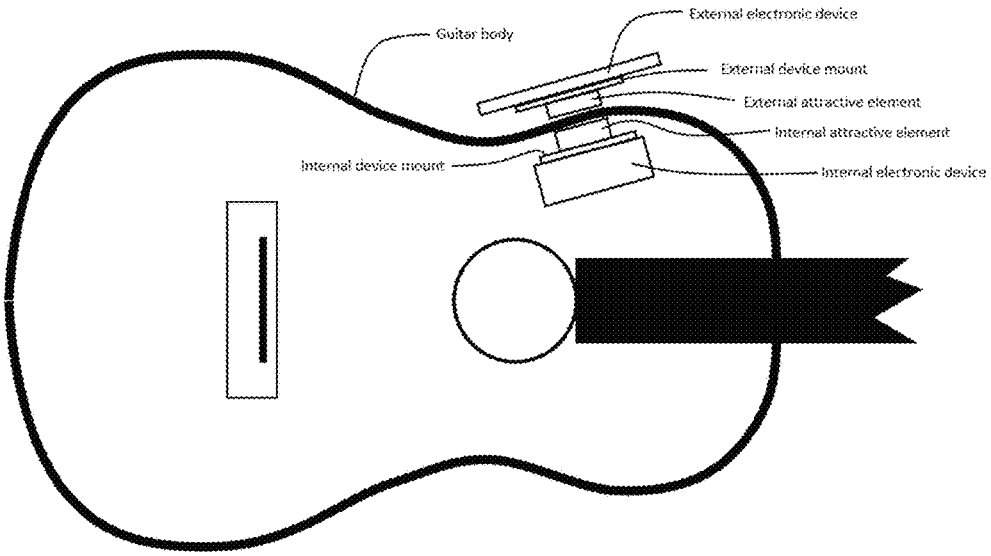
FIG. 4 shows an external electronic device attached to a guitar body, according to exemplary embodiments of the invention.

FIG. 3 shows a schematic transparent plan view of the invention attachment mechanism, where the single magnetically attractive inner and outer elements are replaced by an array of at least two such internal elements, and preferably three or four such elements in order to more precisely align the external electronic device. FIG. 4 shows a schematic transparent plan view of the invention attachment mechanism, where the internal magnetically attractive element has mounted to it a separate electronics module in wireless communication with the external electronic device, and providing additional functionality.

Figure 5:
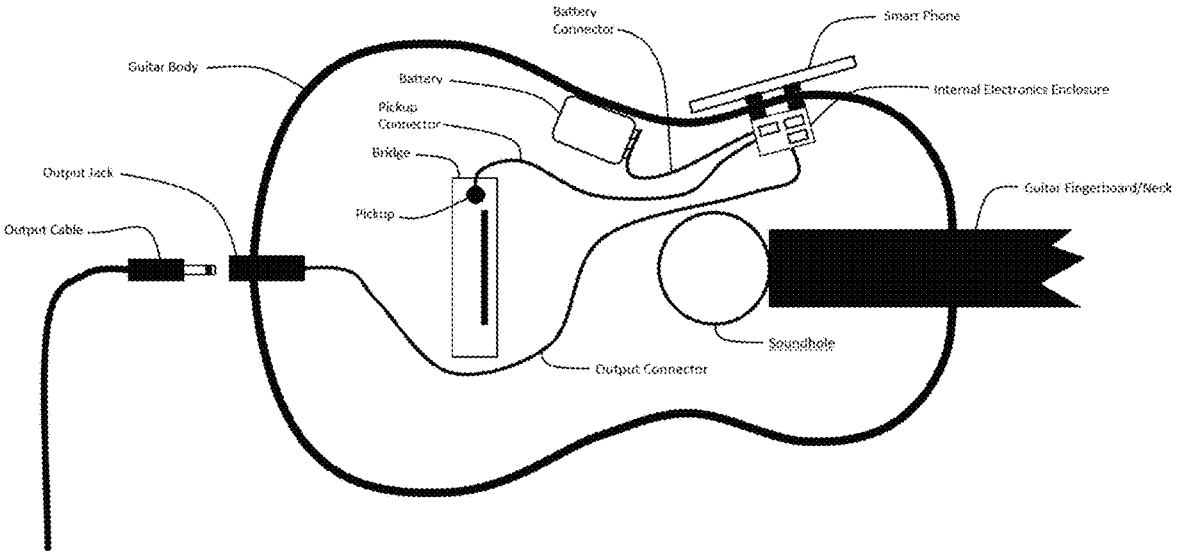
FIG. 5 shows an external electronic device attached to a guitar body with an additional output cable, according to exemplary embodiments of the invention.
Figure 7:
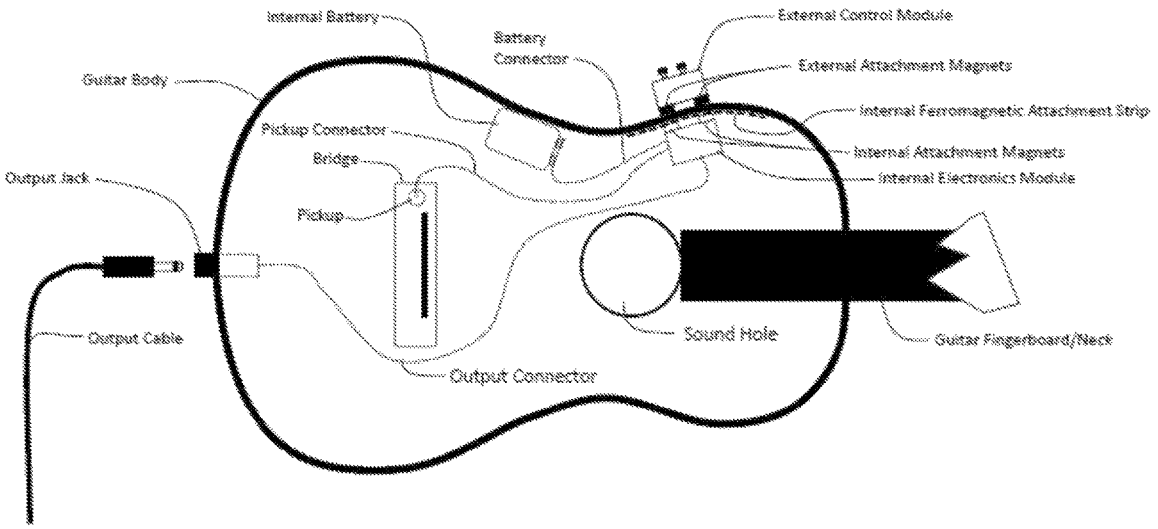
FIG. 7 shows an external electronic device attached to a guitar body with an additional output cable, according to exemplary embodiments of the invention.
Figure 9:
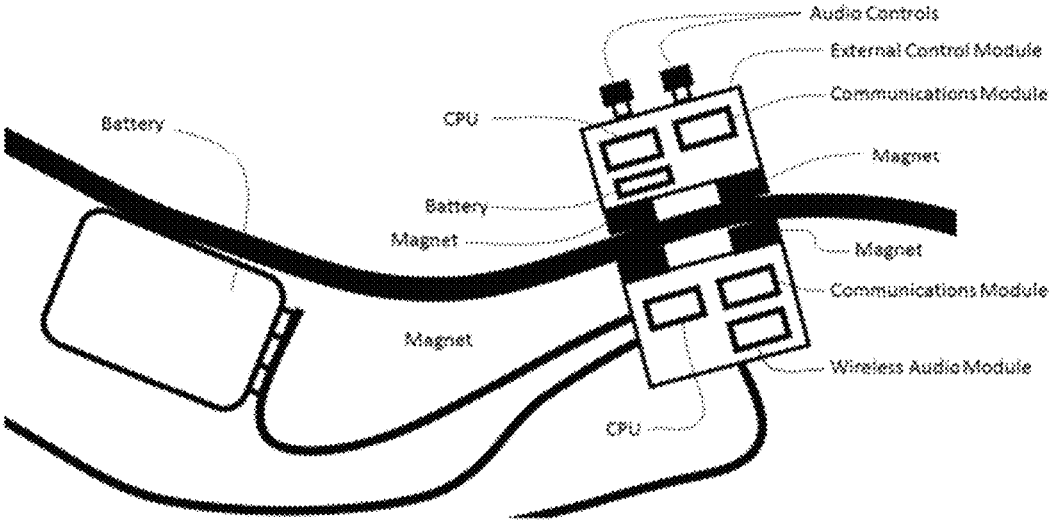
FIG. 9 shows the details of the electronic device attached to a guitar body, according to exemplary embodiments of the invention.
Figure 10:
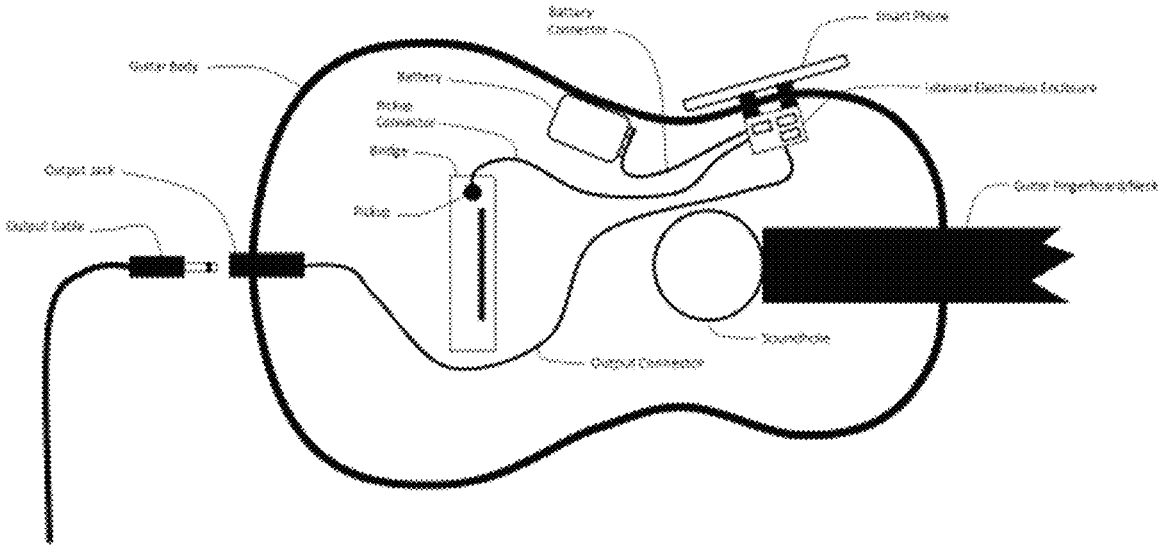
FIG. 10 shows an external electronic device attached to a guitar body with an additional output cable, according to exemplary embodiments of the invention.
Figure 11:
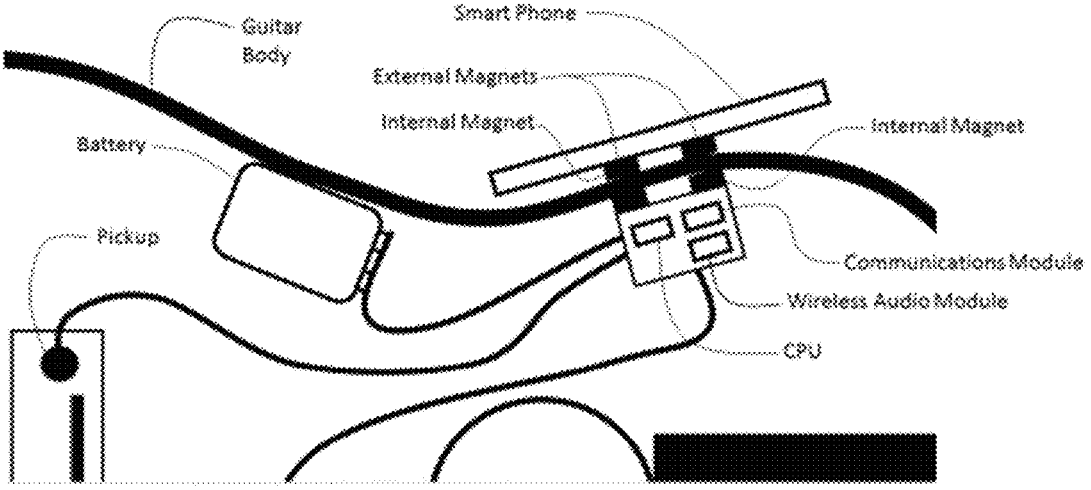
FIG. 11 shows the details of the electronic device attached to a guitar body, according to exemplary embodiments of the invention.
Figure 12:
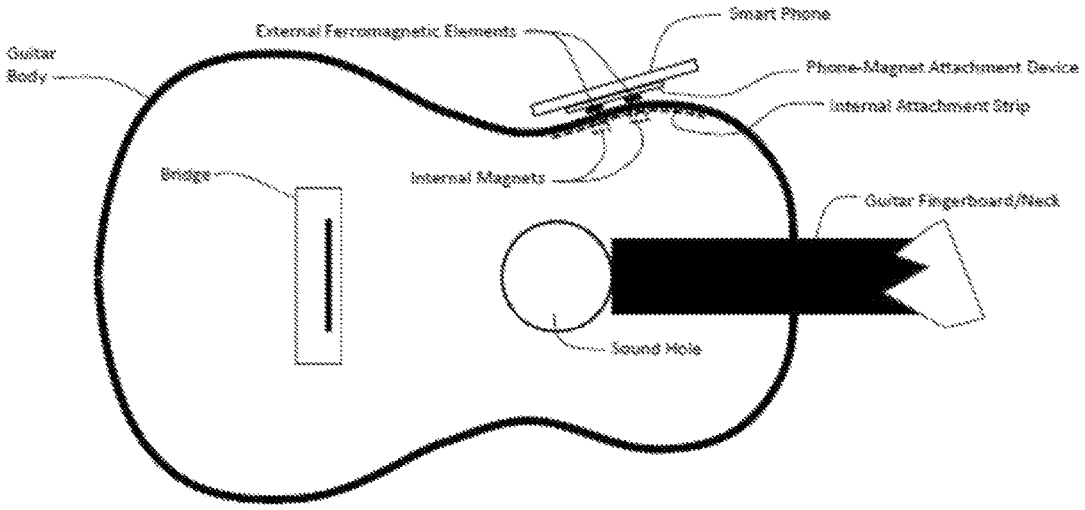
FIG. 12 shows an external electronic device attached to a guitar body, according to exemplary embodiments of the invention.
Figure 13:
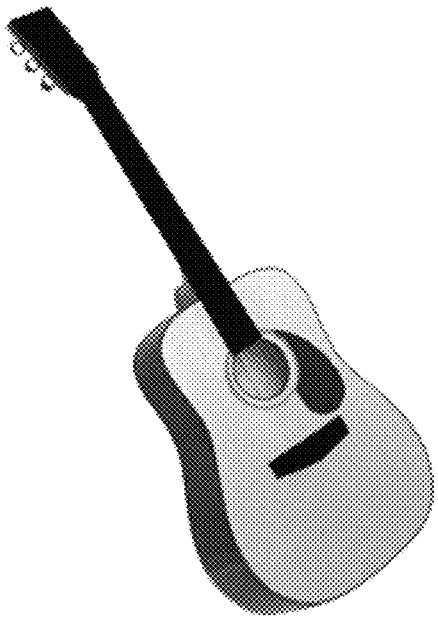
FIG. 13 shows a guitar body, according to exemplary embodiments of the invention.
Figure 14:
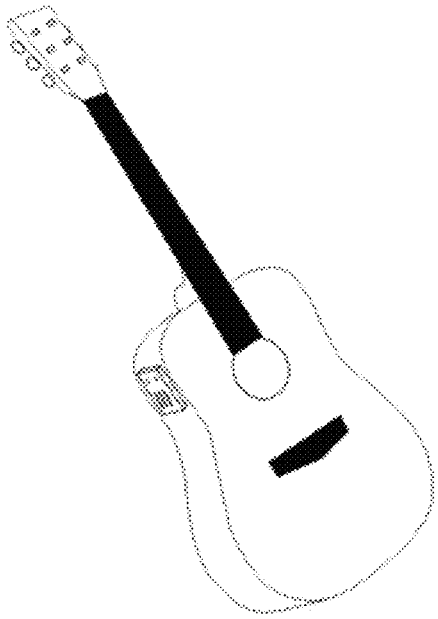
FIG. 14 shows a guitar body with the device attached, according to exemplary embodiments of the invention.
Figure 17:
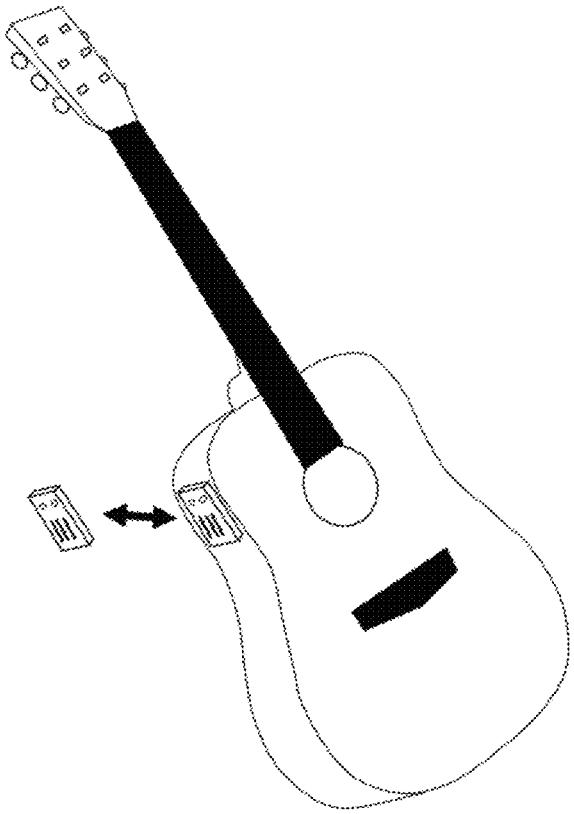
FIG. 17 shows an external electronic device attached to a guitar body with an additional output cable, according to exemplary embodiments of the invention.
Figure 18:
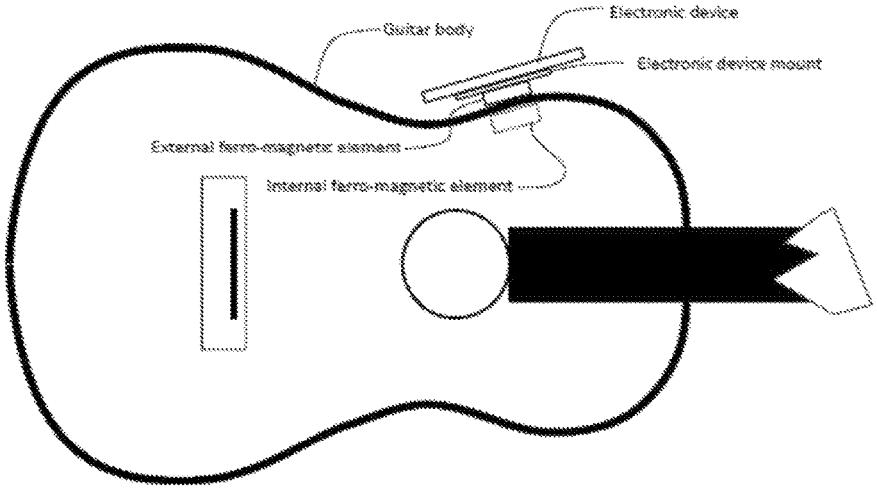
FIG. 18 shows an external electronic device attached to a guitar body, according to exemplary embodiments of the invention.
Figure 19:
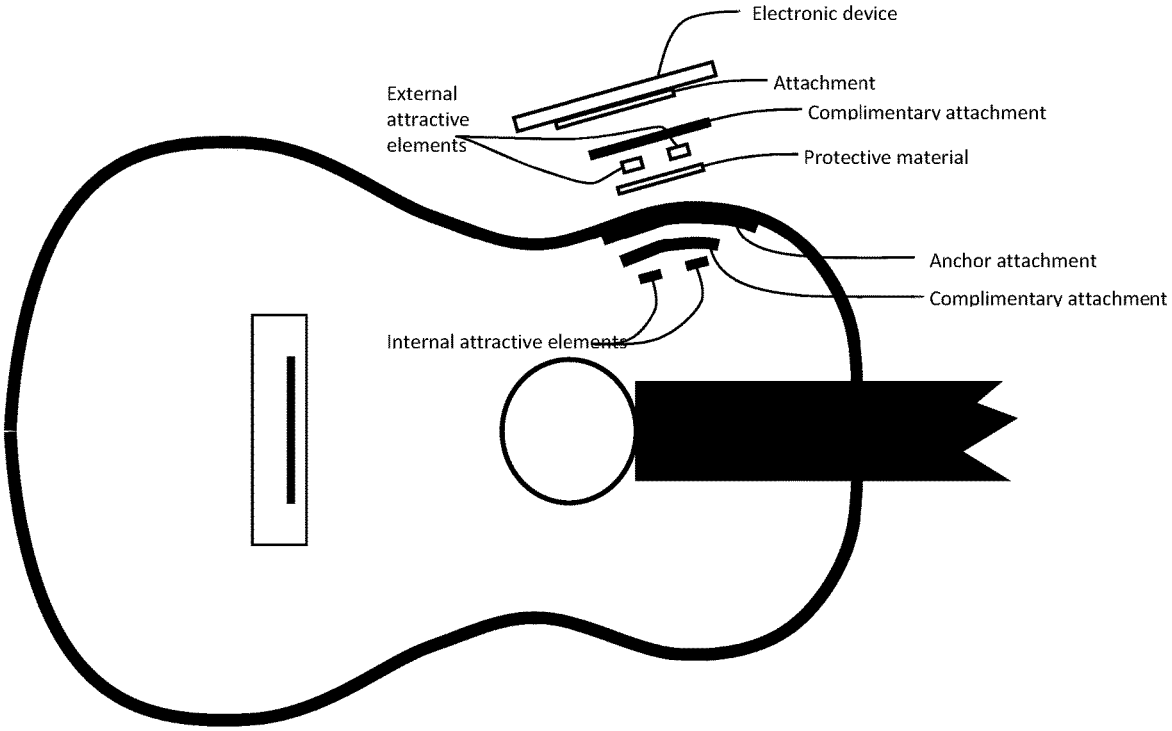
FIG. 19 shows details of the components of an external electronic device attached to a guitar body, according to exemplary embodiments of the invention.
Figure 24:
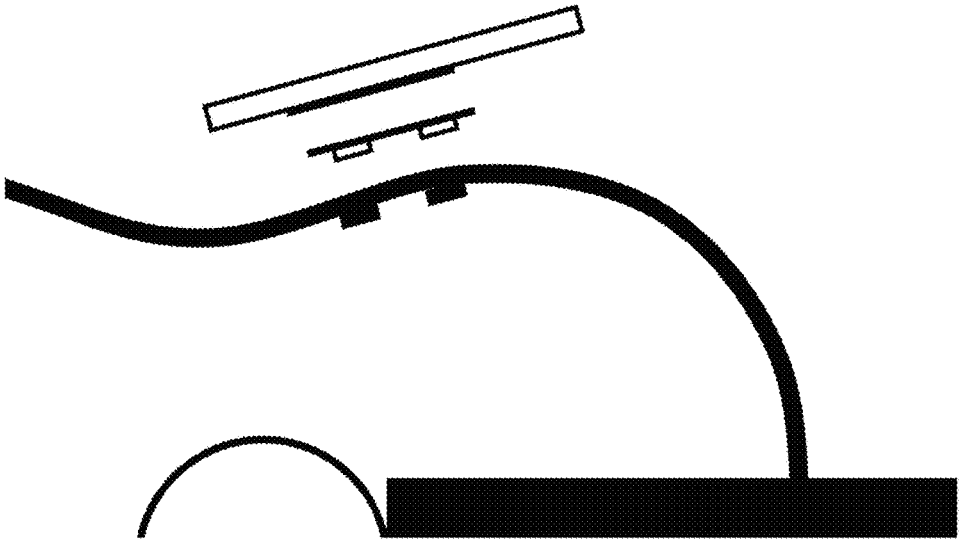
FIG. 24 shows the details of the electronic device attached to a guitar body, according to exemplary embodiments of the invention.
Figure 25A:
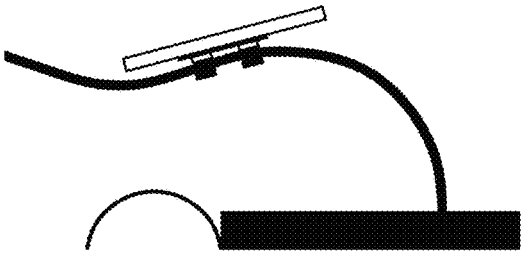
FIG. 25A and FIG. 25B show the details of the electronic device attached to a guitar body, according to exemplary embodiments of the invention.
Figure 25B:
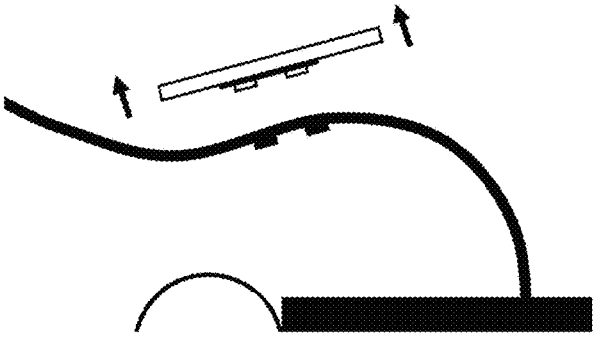
Figure 26:
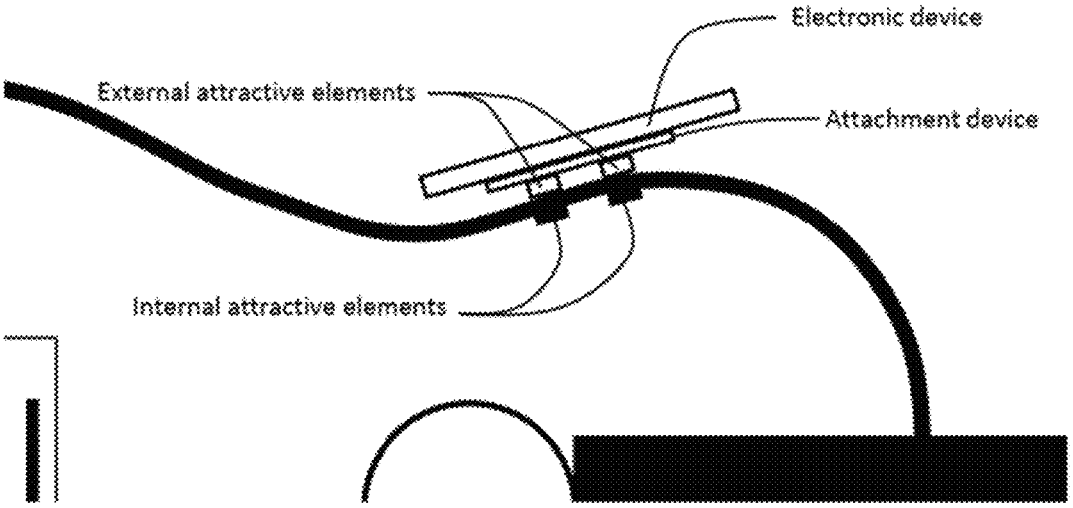
FIG. 26 shows the details of the electronic device attached to a guitar body, according to exemplary embodiments of the invention.

FIG. 5 shows one embodiment of the invention, where the external control module is a smart phone held in place with an array of external magnets, such external magnets being strongly attracted to a corresponding array of internally mounted magnets. The internal magnet array in turn provides a mount for a separate internal electronics module, which receives a weak audio signal from the pickup on the bridge, and amplifies and modifies the output signal according to wireless control signals created by software applications running on the external smart phone.

FIGS. 6A-6C show the front and back of a smart phone equipped with one embodiment of the disclosed invention. FIG. 6A shows the front of the phone, and FIG. 6B shows the back of the phone, where an array of magnets is shown attached to the phone. The array of magnets can be fixed or removably attached to the back of the phone, for example with hook-and-loop fasteners. Alternatively, the array of magnets can be made removable by being built into or attached to the phone's removable case. The letter "N" shown on each magnet indicates the "north" magnetic polarity of each magnet visible in that particular view. FIG. 6C shows the same front view of the phone as FIG. 6A, however shown in outline is the location and polarity of the attached magnet array on the back side of the phone.

Some of the magnetically mounted electronic devices include Smart phone/pad and other arbitrary electronic device/controllers. The products supported include but are not limited to; Magnet patch mounting kits (2 patches & anchor loop strip); Hardware (including Smart internal pre-amp; External tone control module; Stage/recording quality external sound system; as well as Phone case with embedded magnets).

Similarly the possible Software apps include (Display tablature/lyrics); Control music devices (Live recording/playback on smart phone; Control smart internal pre-amp; Control smart external pre-amp/dsp/recording devices).

The market(s) services include: Receiving—Lyrics/Tablature/Play-along apps; Live recording to smart phone; Music Skype (latency issue); Transmitting—Wireless interface to arbitrary external or internal controller, i.e. sound system/stage lighting system/drone, etc.

Figure 27:
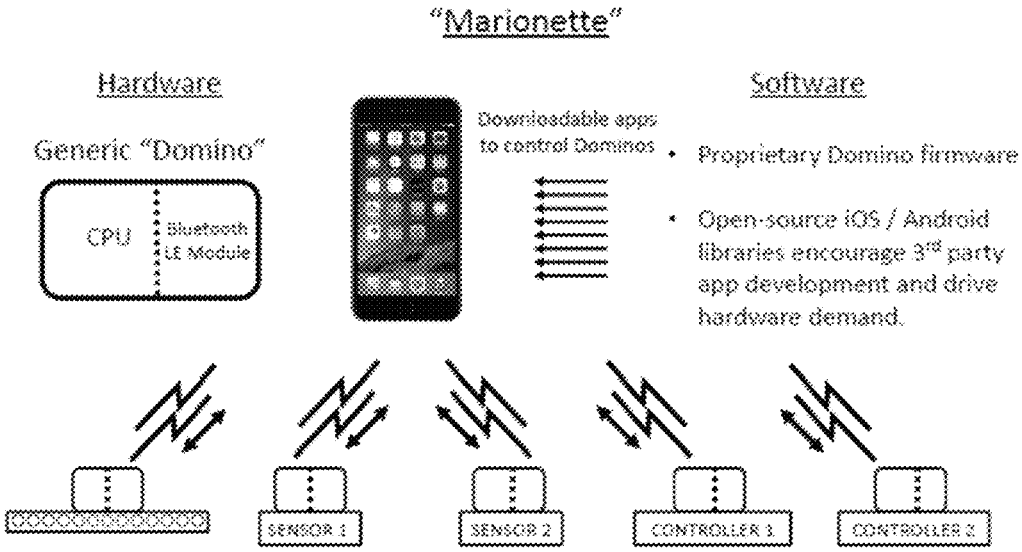
FIG. 27 shows an illustration of the marionette system, according to an exemplary embodiment of the invention.
Figure 28:
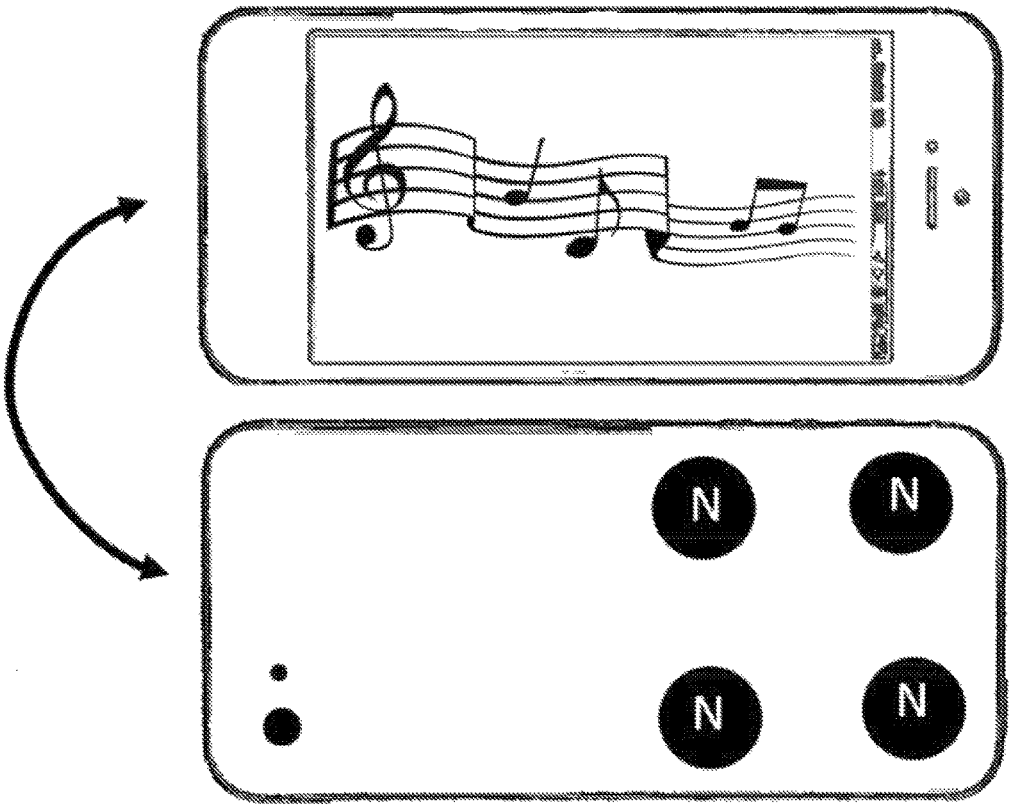
FIG. 28 shows the details of the electronic device attached to a guitar body, according to exemplary embodiments of the invention.
Figure 29:
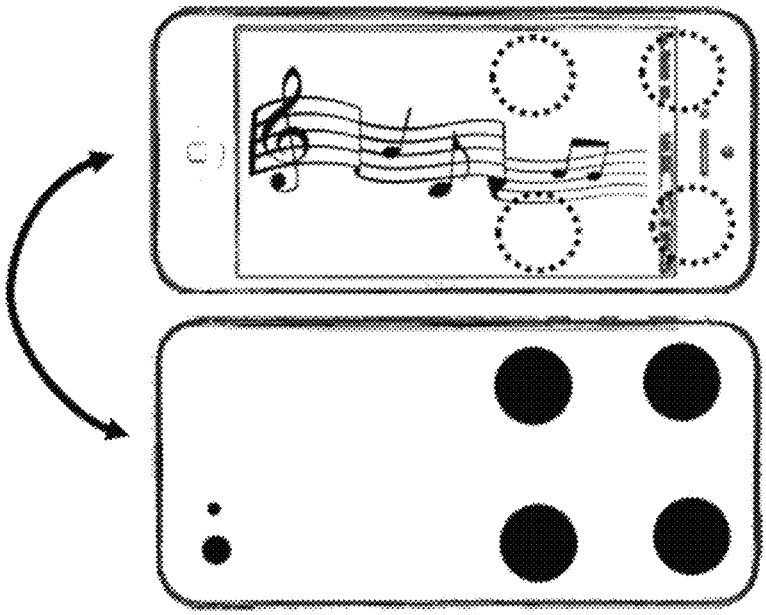
FIG. 29 shows the details of the electronic device attached to a guitar body, according to exemplary embodiments of the invention.
Figure 30:
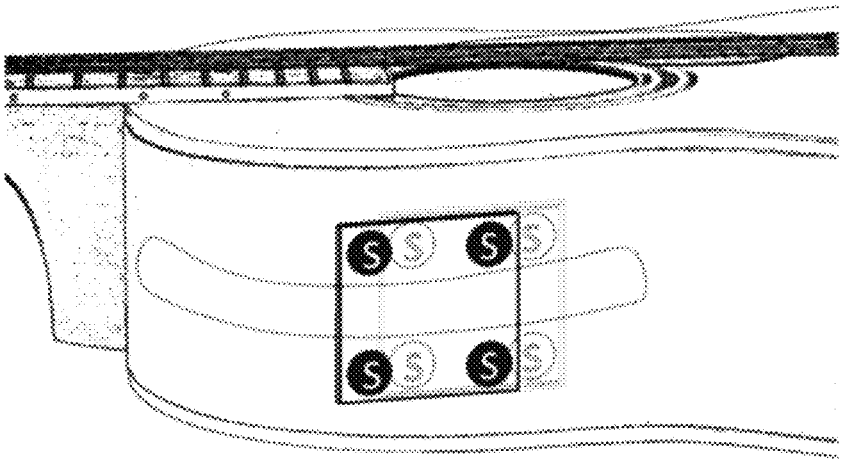
FIG. 30 shows the details of the electronic device attached to a guitar body, according to exemplary embodiments of the invention.
Figure 31:
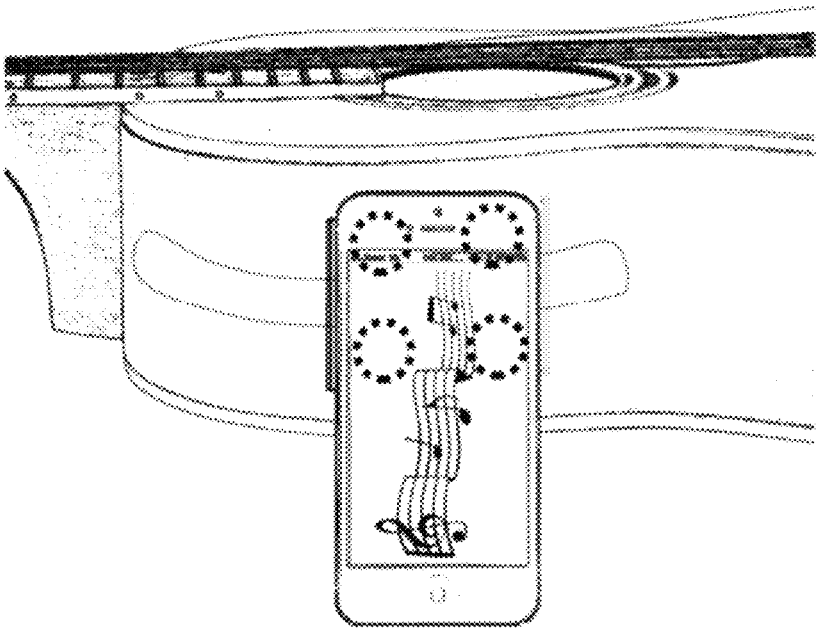
FIG. 31 shows the details of the electronic device attached to a guitar body, according to exemplary embodiments of the invention.
Figure 32:
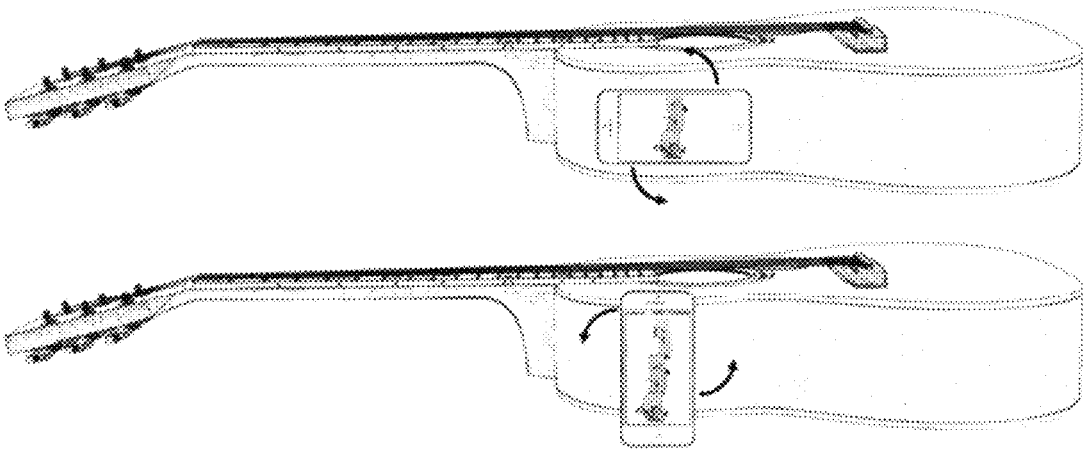
FIG. 32 shows the details of the electronic device attached to a guitar body, according to exemplary embodiments of the invention.
Figure 33:
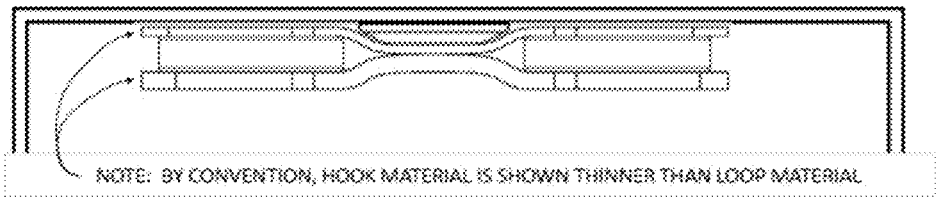
FIG. 33 shows the details of the electronic device attached to a guitar body, according to exemplary embodiments of the invention.
Figure 34:
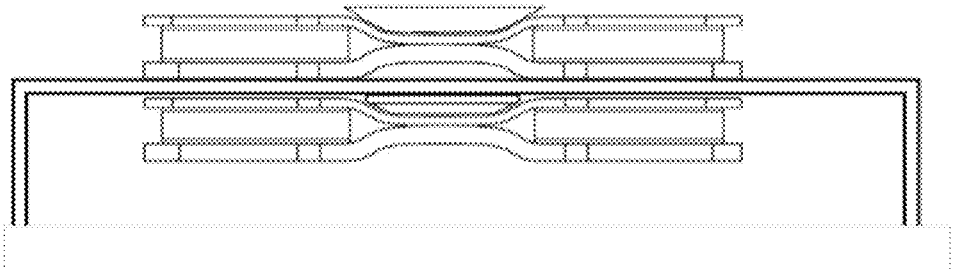
FIG. 34 shows the details of the electronic device attached to a guitar body, according to exemplary embodiments of the invention.
Figure 35:
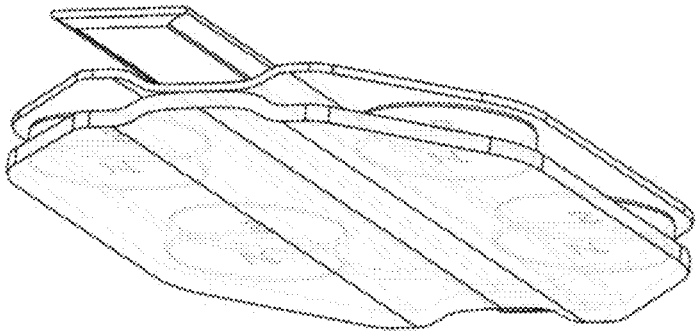
FIG. 35 shows the details of the electronic device attached to a guitar body, according to exemplary embodiments of the invention.
Figure 36:
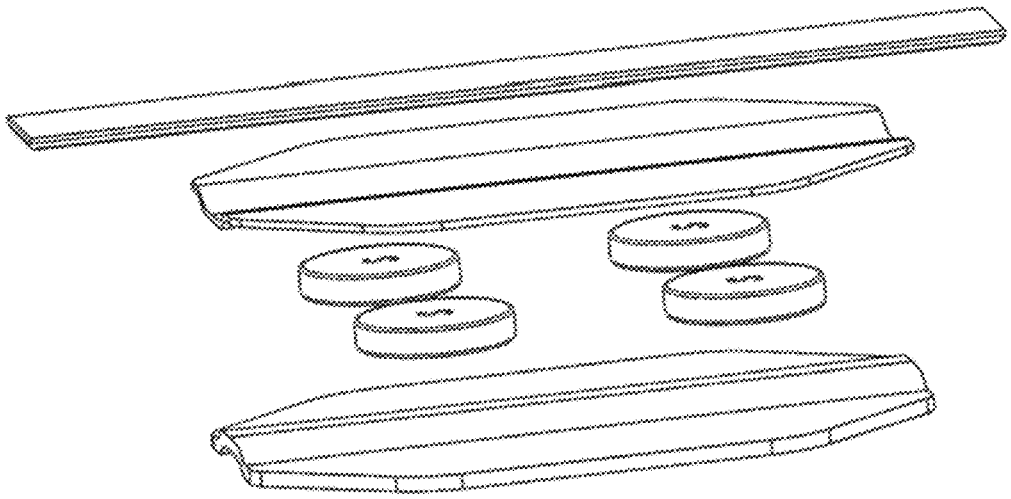
FIG. 36 shows the details of the electronic device attached to a guitar body, according to exemplary embodiments of the invention.
Figure 37:
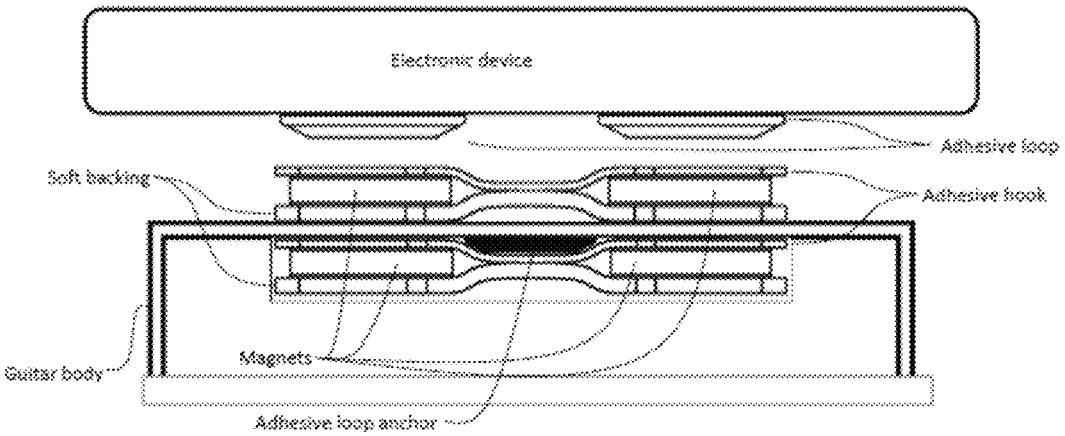
FIG. 37 shows the details of the electronic device attached to a guitar body, according to exemplary embodiments of the invention.
Figure 38:
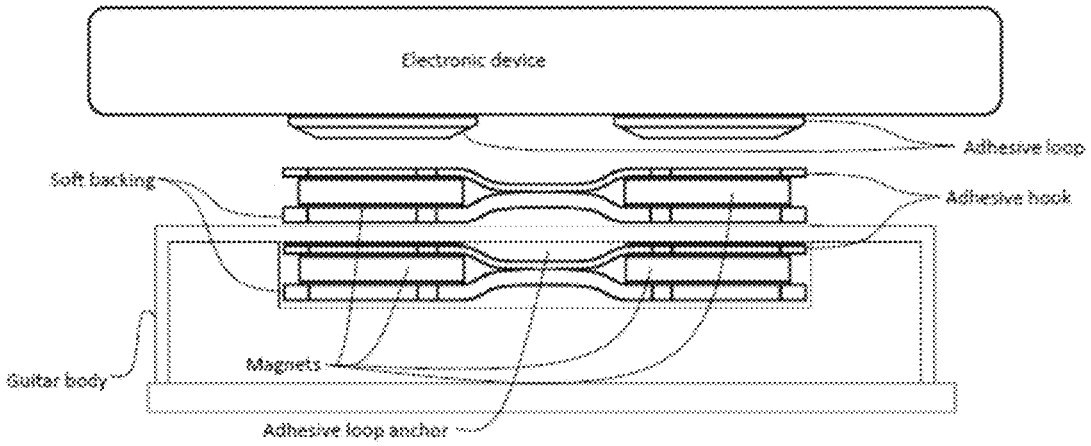
FIG. 38 shows the details of the electronic device attached to a guitar body, according to exemplary embodiments of the invention.
Figure 39:
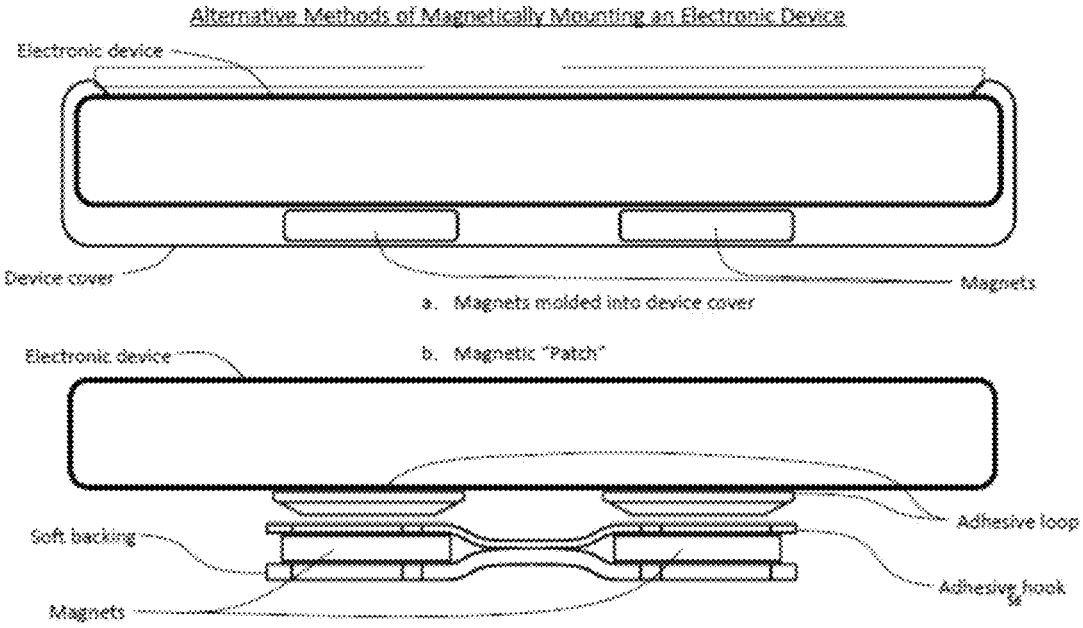
FIG. 39 shows the details of the electronic device attached to a guitar body, according to exemplary embodiments of the invention.
Figure 40:
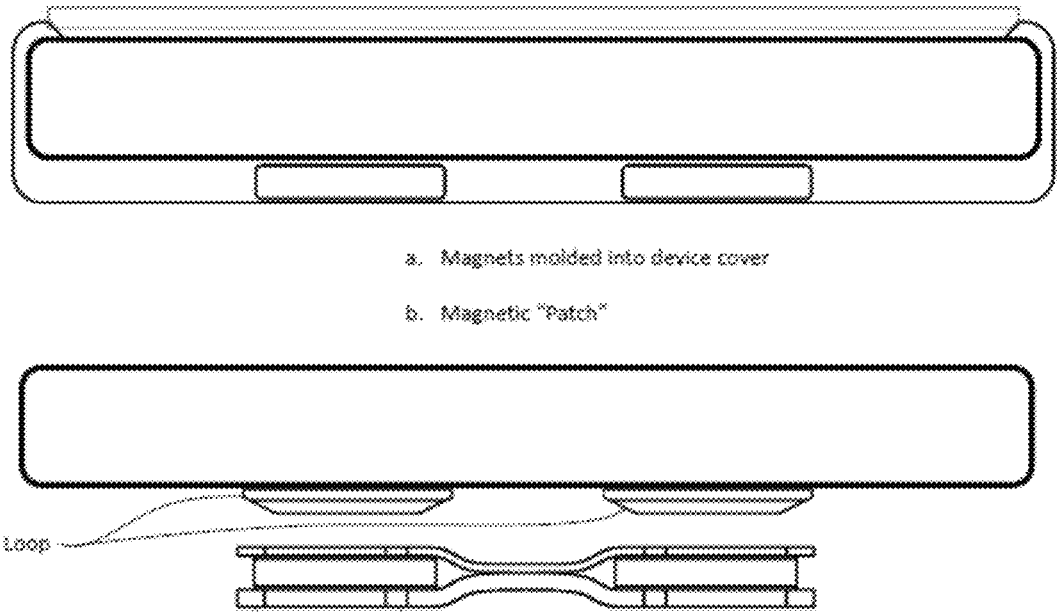
FIG. 40 shows the details of the electronic device attached to a guitar body, according to exemplary embodiments of the invention.

Referring to FIG. 27, we see a scheme where a smart device (smartphone/tablet/smartwatch and/or PC), let's say an iPhone can communicate with and control any of the domino-equipped sensors or controllers in range. In one embodiment, the Marionette connects to the magnetically attached external guitar controller so that a volume- and tone-modulating device located in or in the vicinity of the guitar may be controlled by the iPhone mounted on the guitar.

For example, a separate LED light-show on the instrument or musician or guitar or stage could be controlled simultaneously from the same iPhone, or as many slave devices as the musician could handle. By having all slave device processing being done separate from the controller/iphone, there would not be any iphone bandwidth issues.

Referring to FIGS. 41-59, we see a series of embodiments that address the issue of magnet cards for phone cases being thick, where we suspect that you may put one in your pocket with your credit cards and POOF! No more credit! Similarly, the magnetic mount inside the guitar (Named Handi) may be perceived to permanently add mass to the instrument, not necessarily a great thing from a guitarist's perspective. Additionally, it hangs on that adhesive Velcro® strip, which can come unattached and would be painful to put back in, as you will need a new piece of Velcro with fresh adhesive.

Thus, in an alternate embodiment, the magnet device (which we call a Frog) is magnetically endowed to act as a middle magnet mounted outside the skin of the instrument. It replaces both the plastic magnetic mount inside the guitar and the magnetic phone card, with simple pieces of thin ferrous stock (such as steel and other metals). The Frog's magnet array attracts both the phone/tablet ferrous strip, pulling the phone down onto the flat frog face and pulling the curved inner steel sheet up against the curved inner face of the guitar, mounted there by some thin Velcro. The result is a highly stable configuration, which can be made arbitrarily stronger by making the frog taller with more magnets stacked up.

The frog as one embodiment of the more basic invention of a "magnetic bridge" between a device equipped with a metal strip and a metal surface on a guitar body (captures electric guitar version). The frog is for an acoustic guitar, and the magnet-equipped bracket for an electric guitar.

Figure 41:
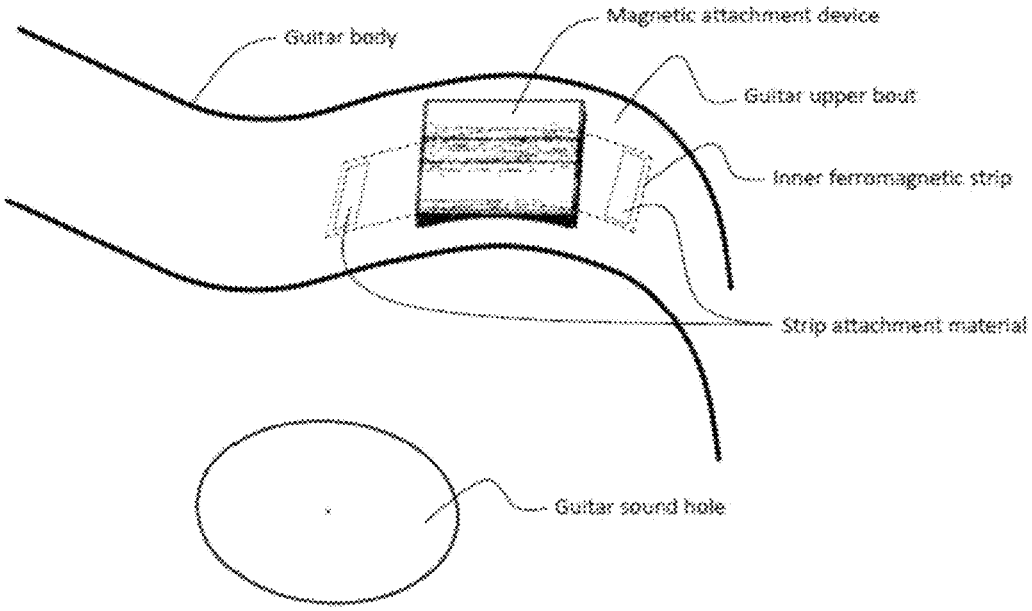
FIG. 41 shows an oblique view of the device on a guitar body, according to exemplary embodiments of the invention.
Figure 42:
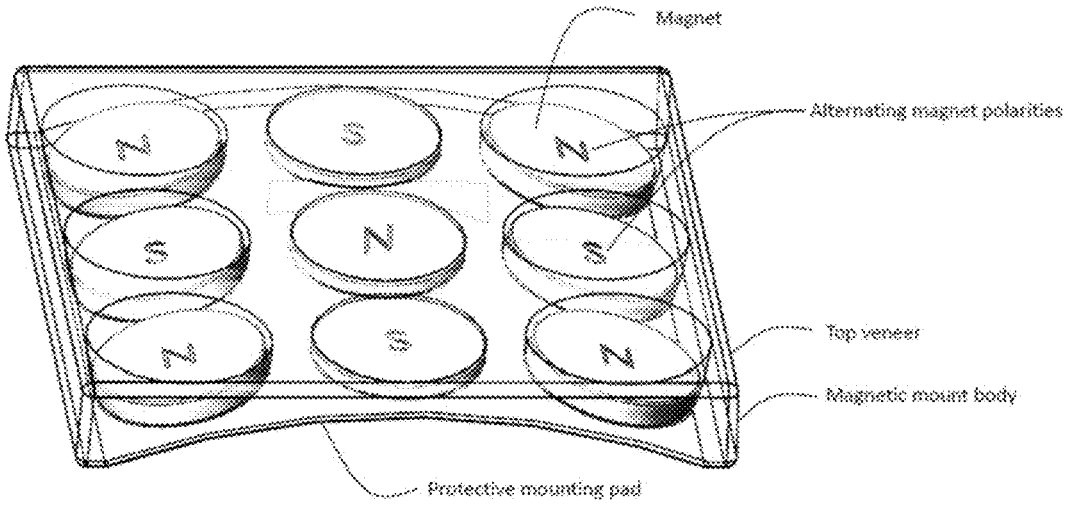
FIG. 42 shows an oblique transparent view of the proposed magnetic device, according to exemplary embodiments of the invention.

As the central player, the magnet device is easy to produce, fits/adapts to the curve on the top of the instrument, of turns the whole original concept inside out by making the Frog the central player in the product/system/kit. FIG. 41 shows the magnetic attachment device mounted on the outer surface of the upper bout of an acoustic guitar, held in place by magnetic attraction to a removable ferromagnetic strip attached to the inner surface of the guitar opposite the magnetic attachment device. FIG. 42 shows an oblique transparent view of the magnetic attachment device with its internal array of magnets. The polarity of the magnets is shown to alternate with respect to nearest neighbors.

Figure 43:
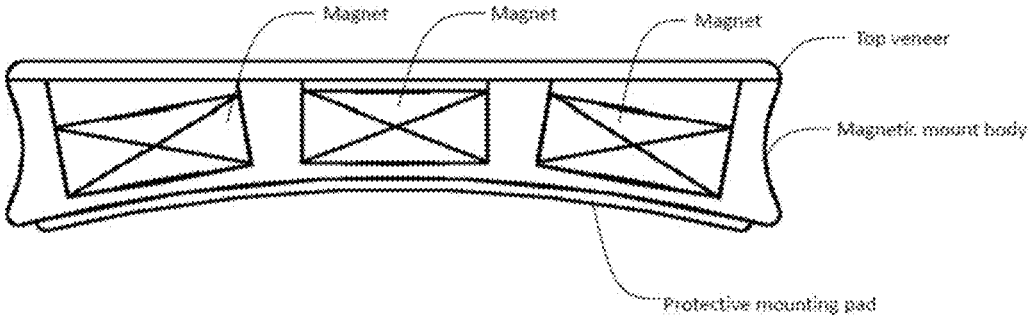
FIG. 43 shows a Side View Cross-Section with Multiple Magnets of the proposed magnetic device, according to exemplary embodiments of the invention.
Figure 44:
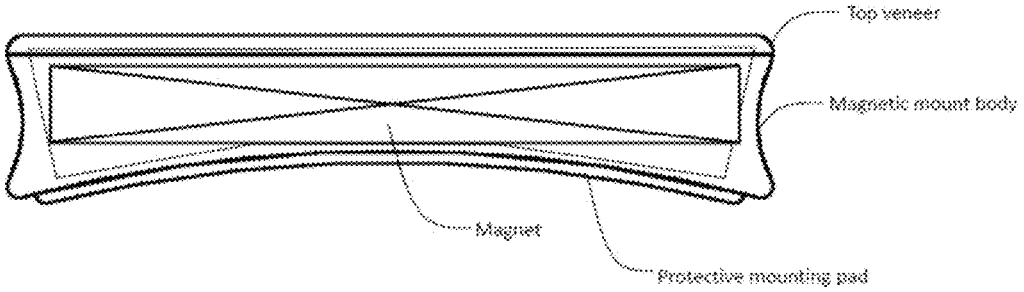
FIG. 44 shows a Side View Cross-Section with Single Large Magnet of the proposed magnetic device, according to exemplary embodiments of the invention.
Figure 45:
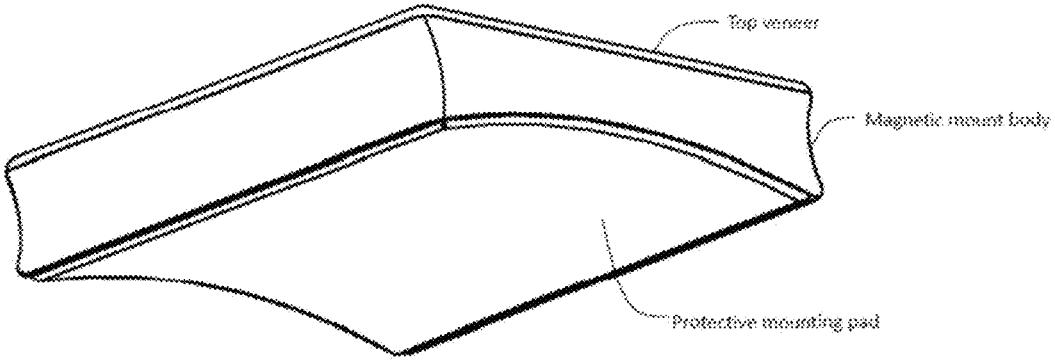
FIG. 45 shows a Lower Oblique View—Device Shown With Single Protective Mounting Pad of the proposed magnetic device, according to exemplary embodiments of the invention.

Referring to FIG. 43 it shows a side view cross-section through the magnetic attachment device showing the magnet's non-parallel alignment allowing close proximity to the mounting surface. FIG. 44 shows a side view cross-section through the magnetic attachment device where a single large magnet is used in place of a multiple-magnet array. FIG. 45 shows a lower oblique view of the magnetic attachment device with a protective material on its underside contact surface to prevent marring of the guitar surface.

Figure 46:
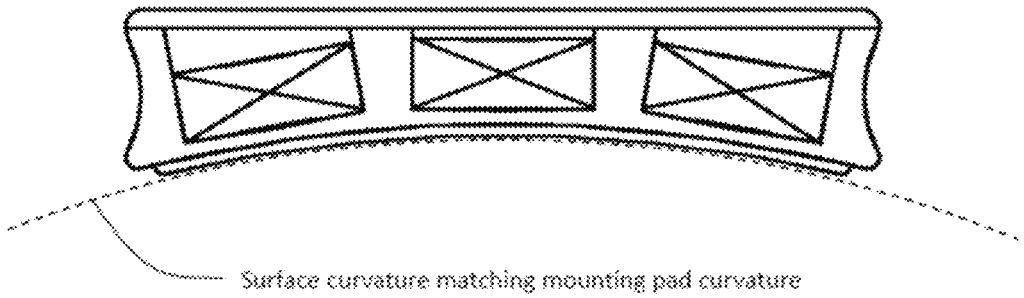
FIG. 46 shows a Side View—Cross-Section of Magnetic System with Single Protective Mounting Pad Matching the Curvature of the Guitar Surface to Which it is Attached, according to exemplary embodiments of the invention.
Figure 47:
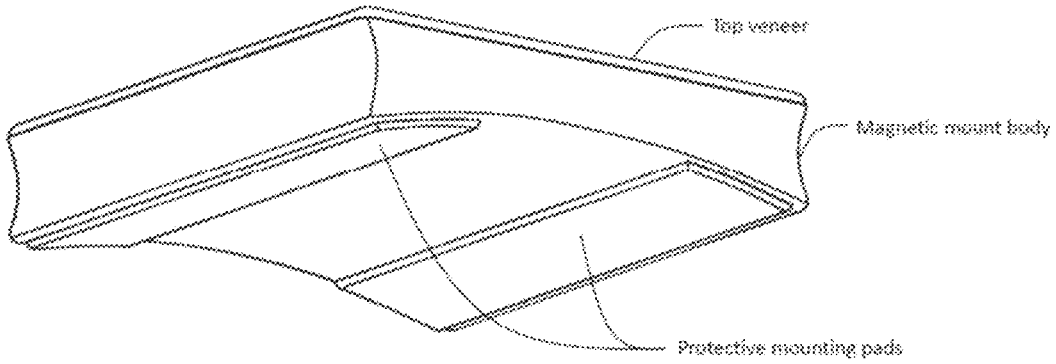
FIG. 47 shows a Lower Oblique View—Device Shown With Multiple Mounting Pads, according to exemplary embodiments of the invention.
Figure 48:
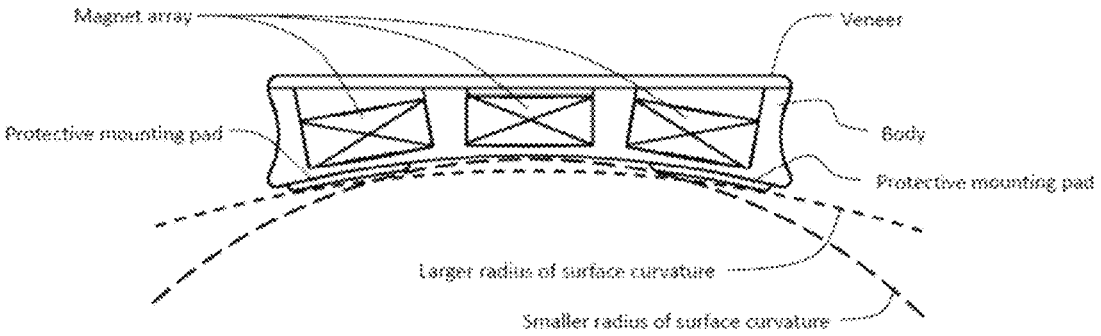
FIG. 48 shows a Side View—Cross-Section of Device with Dual Protective Mounting Pads Allowing Secure Attachment Over a Range of Curvatures, according to exemplary embodiments of the invention.
Figure 49:
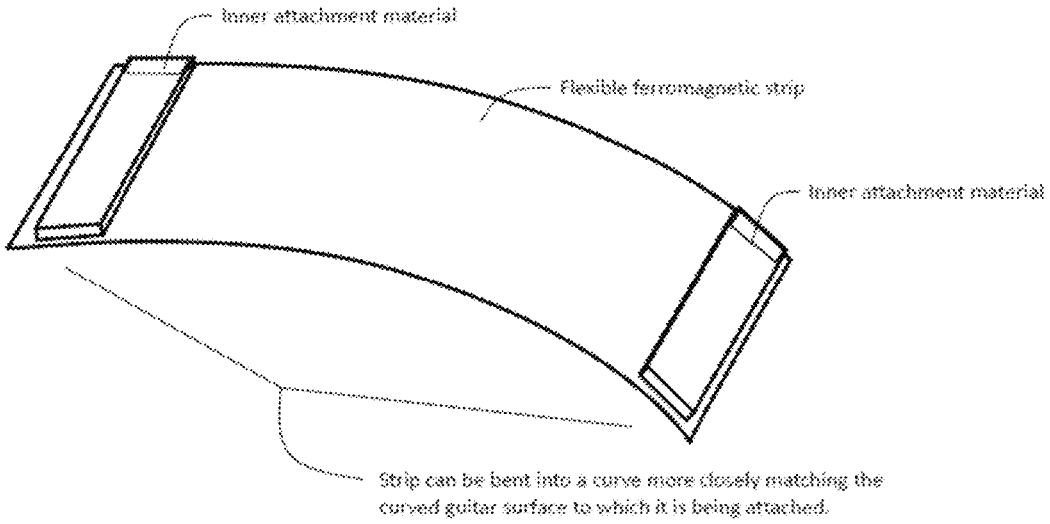
FIG. 49 shows an Upper Oblique View—Inner Ferromagnetic Strip, according to exemplary embodiments of the invention.

FIG. 46 shows a side view cross-section of the magnetic attachment device where the underside curvature of the device closely matches the mounting surface curvature. FIG. 47 shows a lower oblique view of the magnetic attachment device where the underside protective material consists of two separate pieces, FIG. 48 shows a side view cross-section of the magnetic attachment device where the two-piece protective material allows secure attachment to a mounting surface over a range of curvatures. FIG. 49 shows the flexible ferromagnetic strip to be removably attached to the inside surface of the guitar opposite the magnetic mounting device.

Figure 50:
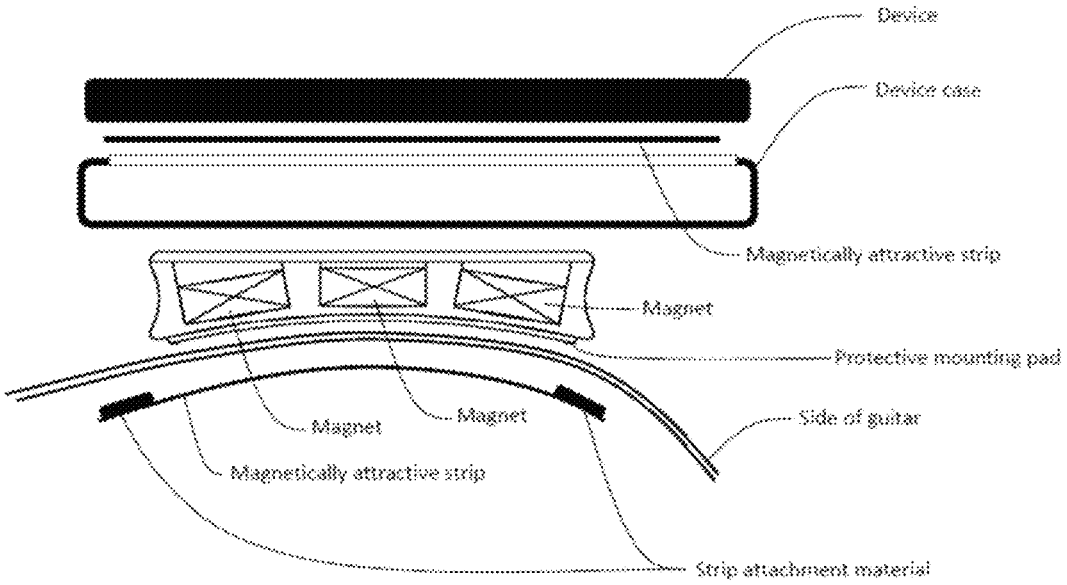
FIG. 50 shows a Side View—Exploded Cross-Section of Magnetic System on Guitar, according to exemplary embodiments of the invention.
Figure 51:
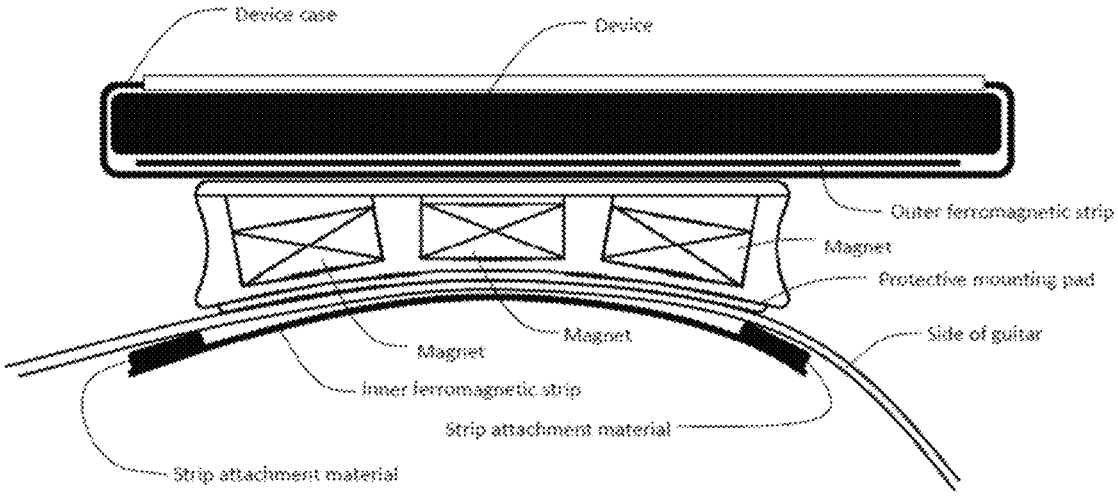
FIG. 51 shows a Side View—Cross-Section of Assembled Magnetic System on Guitar, according to exemplary embodiments of the invention.
Figure 52:
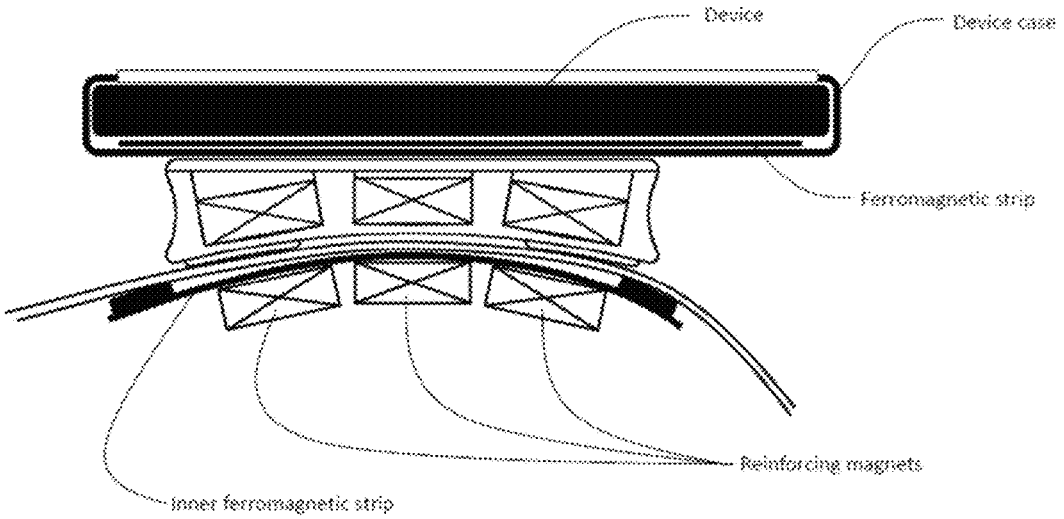
FIG. 52 shows a Side View—Cross-Section of Device Mounted on Guitar with Additional Reinforcing Inner Magnetic Array, according to exemplary embodiments of the invention.

FIG. 50 shows an exploded side view cross-section of the magnetic attachment system assembly's components. FIG. 51 shows a side view cross-section of the magnetic attachment system assembly. FIG. 52 shows a side view cross-section of the magnetic attachment system assembly where reinforcing magnets have been attached to the inner flexible ferromagnetic strip to increase the attachment force holding the magnetic mounting device to the side of the guitar as well as the attachment force holding the attached device to the magnetic mounting device.

Figure 53:
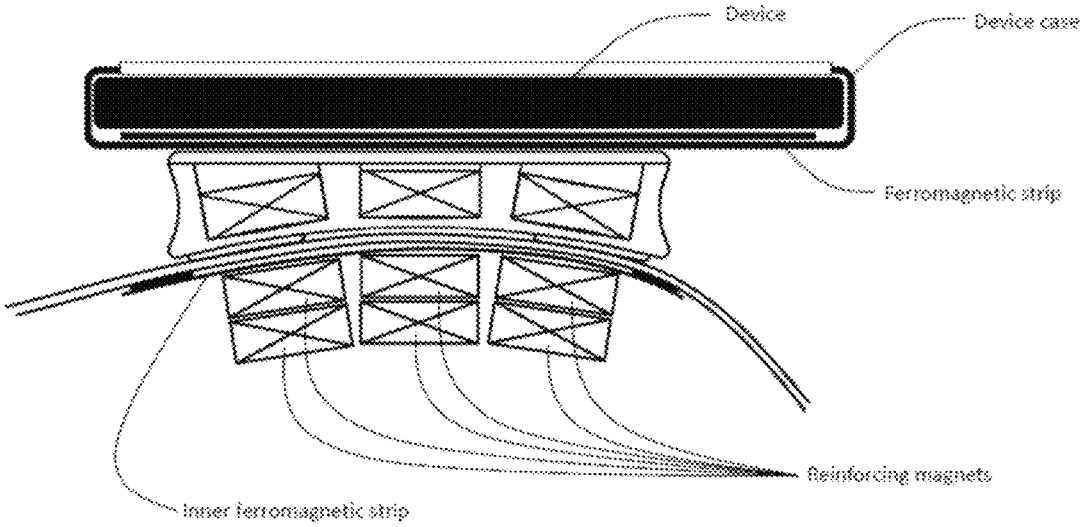
FIG. 53 shows a Side View—Cross-Section of Device and Mount with Doubled Reinforcing Magnets, according to exemplary embodiments of the invention.
Figure 54A:
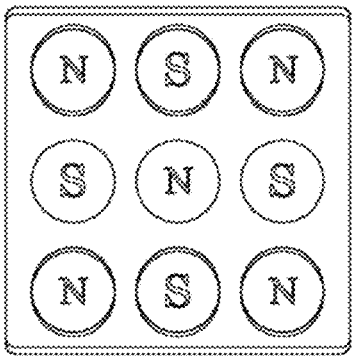
FIGS. 54A-54B show Top Views—Vertical Cross-Sections of Magnetic Mounts showing Alternative Magnetic Polarity Patterns of Separated Magnets, according to exemplary embodiments of the invention.
Figure 54B:
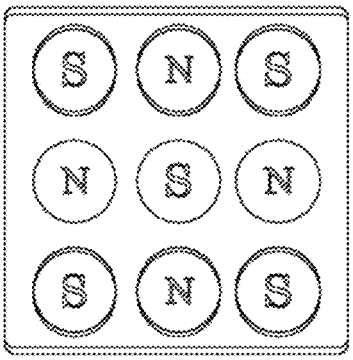

FIG. 53 shows a side view cross-section of the magnetic attachment system assembly where arbitrary additional reinforcing magnets have been attached to the inner flexible ferromagnetic strip to increase further the attachment force holding the magnetic mounting device to the side of the guitar as well as the attachment force holding the attached device to the magnetic mounting device. FIG. 54A shows a transparent top view of the magnetic attachment device where the magnets are spaced apart from each other and the polarities of adjacent magnets are opposite. FIG. 54B shows a transparent top view of the magnetic attachment device where the polarity of adjacent magnets are spaced apart from each other and opposite as in FIG. 55*a*, but the overall polarity pattern is inverted.

Figure 55A:
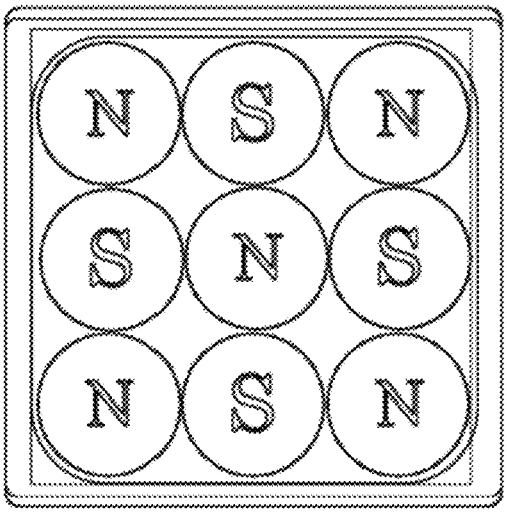
FIGS. 55A-55B show Top Views—Vertical Cross-Sections of Magnetic Mounts showing Alternative Magnet Polarity Patterns of Adjacent Magnets, according to exemplary embodiments of the invention.
Figure 55B:
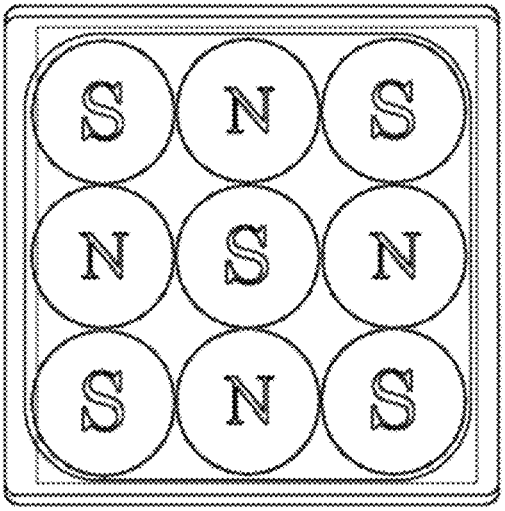
Figure 56:
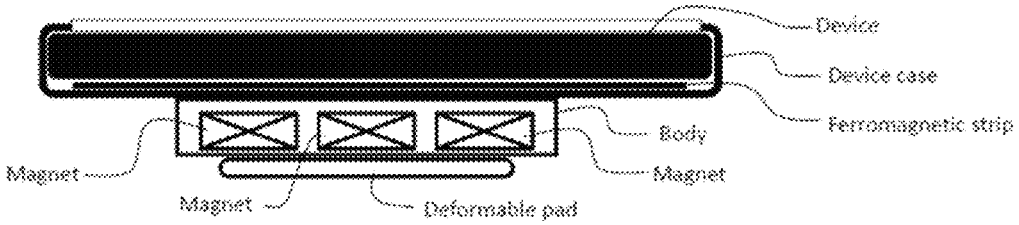
FIGS. 56-57 show Side Views—Cross-Sections of Magnetic Mount With Deformable Mounting Pad, according to exemplary embodiments of the invention.
Figure 57:
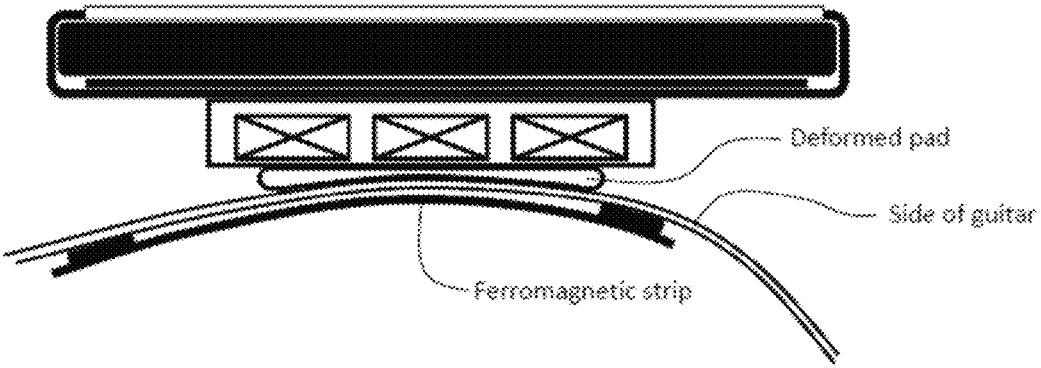
Figure 58:
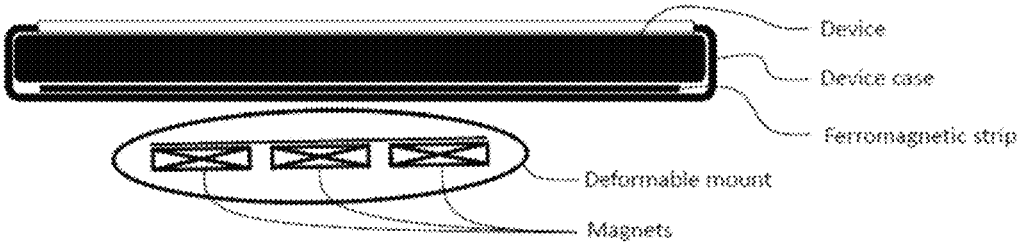
FIGS. 58-59 show Side Views—Cross-Sections of Magnetic Mount With Deformable Mounting Pads Incorporating Magnets, according to exemplary embodiments of the invention.
Figure 59:
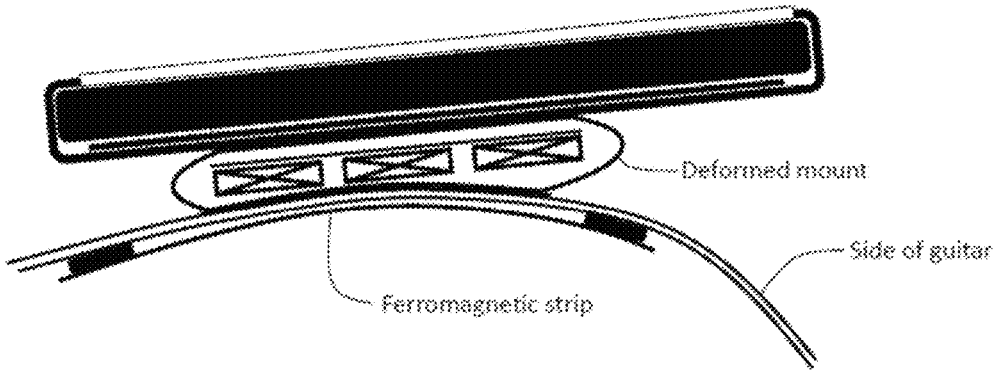

FIG. 55A shows a transparent top view of the magnetic attachment device where the magnets are touching and the polarities of adjacent magnets are opposite. FIG. 55B shows a transparent top view of the magnetic attachment device where the polarity of adjacent magnets are touching and opposite as in FIG. 55*a*, but the overall polarity pattern is inverted. FIGS. 56-57 show a side view cross-section of the magnetic attachment system assembly where the protective material on the underside of the magnetic mount consists of a deformable material. FIGS. 58-59 show a side view cross-section of the magnetic attachment system assembly where the protective material on the underside of the magnetic mount consists of a deformable material containing one or more magnets.

Figure 60A:
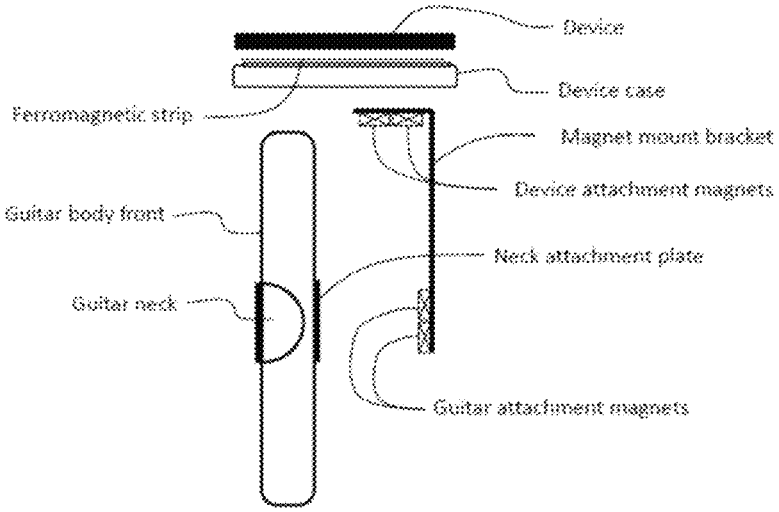
FIGS. 60A-60B show End View of Electric Guitar With Magnetic Device Mount Attached to Ferromagnetic Plate on Guitar (Exploded and Assembled respectively), according to exemplary embodiments of the invention.
Figure 60B:
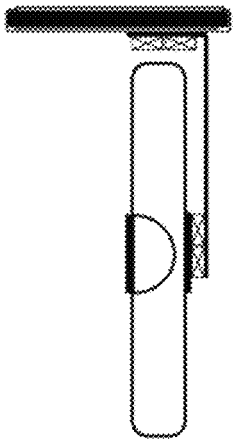
Figure 61:
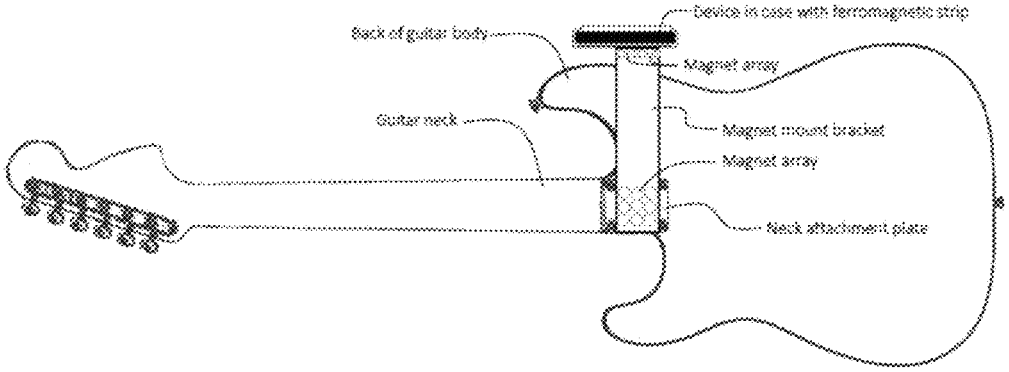
FIG. 61 shows a Rear View of Electric Guitar With Magnetic Device Mount Attached to Metal Plate on Guitar, according to exemplary embodiments of the invention.
Figure 62:
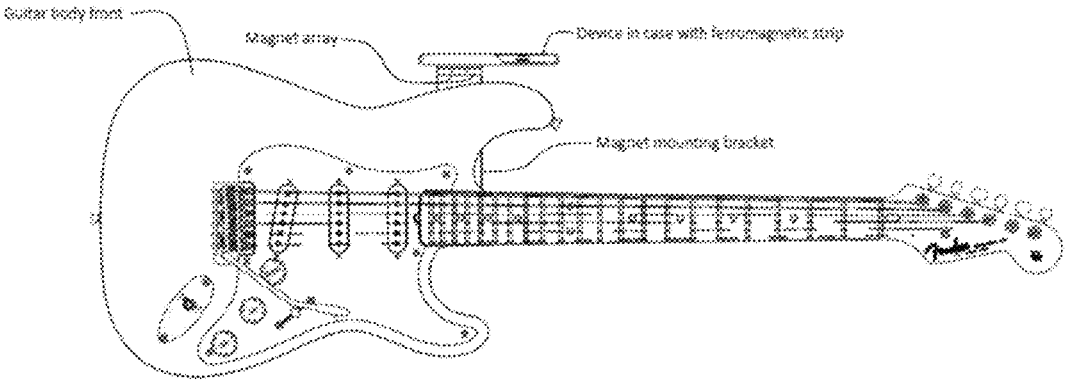
FIG. 62 shows a Front View of Electric Guitar With Magnetic Device Mount Attached to Ferromagnetic Plate on Guitar, according to exemplary embodiments of the invention.

FIGS. 60A-60B show schematic end views of an electric guitar equipped with a metal neck attachment plate on its back side, where a mounting bracket equipped with magnet arrays at its opposite ends attaches to the guitar with one magnet array and to a mounted device with the other magnet array. FIG. 61 shows a rear view of an electric guitar equipped with a metal neck attachment plate on its back side, where a mounting bracket equipped with magnet arrays at its opposite ends attaches to the guitar with one magnet array and to a mounted device with the other magnet array. FIG. 62 shows a front view of an electric guitar equipped with a metal neck attachment plate on its back side, where a mounting bracket equipped with magnet arrays at its opposite ends attaches to the guitar with one magnet array and to a mounted device with the other magnet array.

Figure 63:
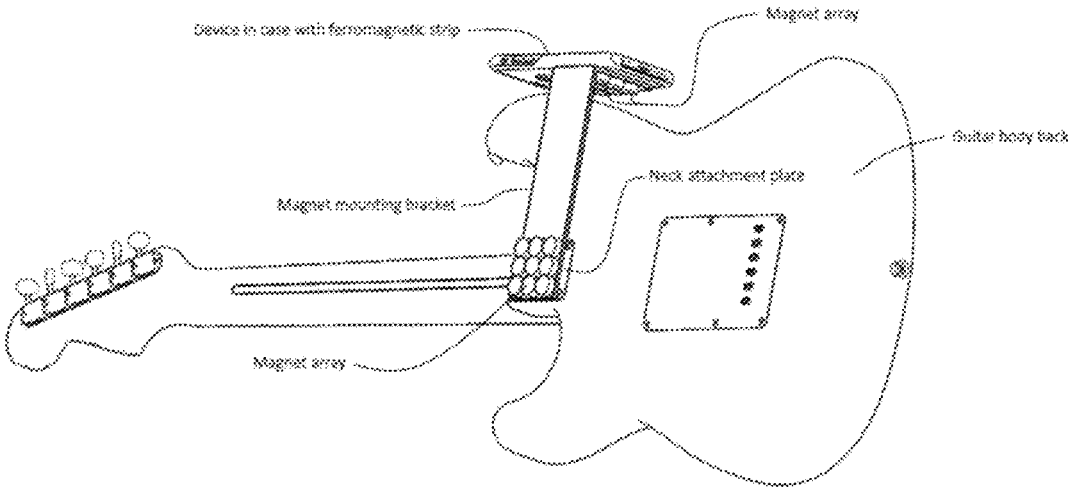
FIG. 63 shows a Rear Oblique View of Electric Guitar With Magnetic Device Mount Attached to Neck Attachment Plate, according to exemplary embodiments of the invention.
Figure 64:
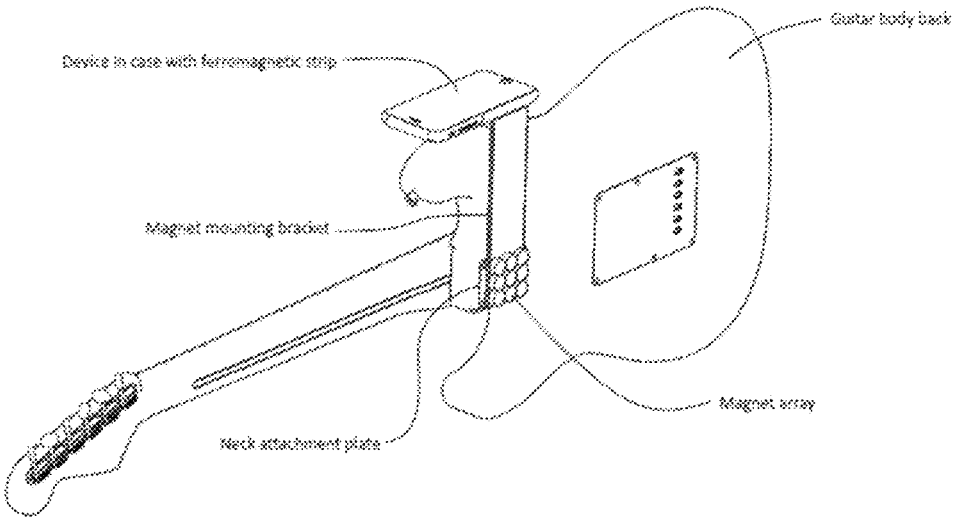
FIG. 64 shows a Rear Oblique View of Electric Guitar With Magnetic Device Mount Attached to Neck Attachment Plate, according to exemplary embodiments of the invention.
Figure 65:
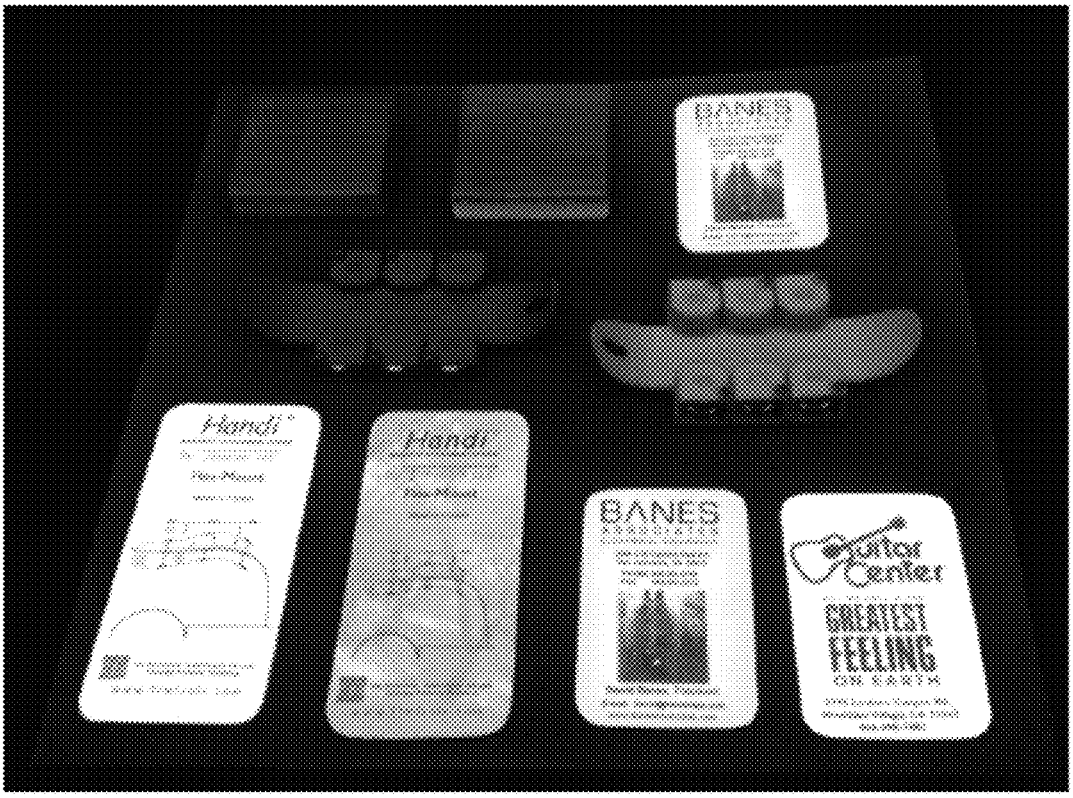
FIGS. 65-67 show alternate versions of various device components, according to exemplary embodiments of the invention.
Figure 66:
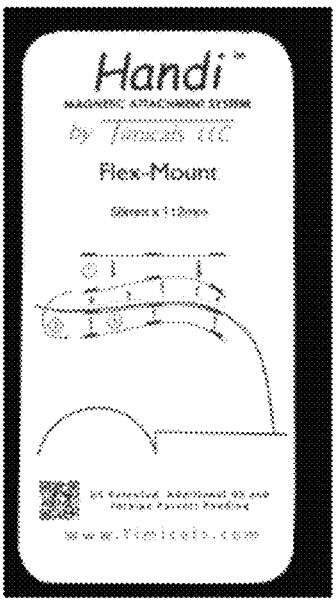
Figure 67:
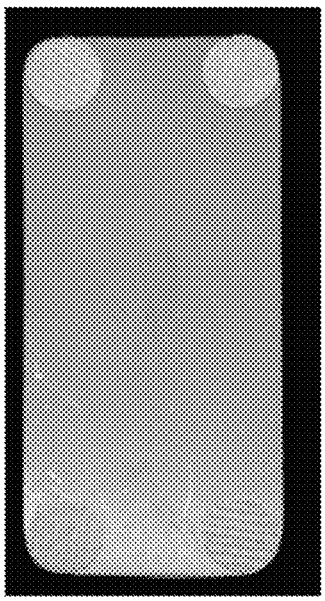
Figures 68A, 68B, 68C, 68D:
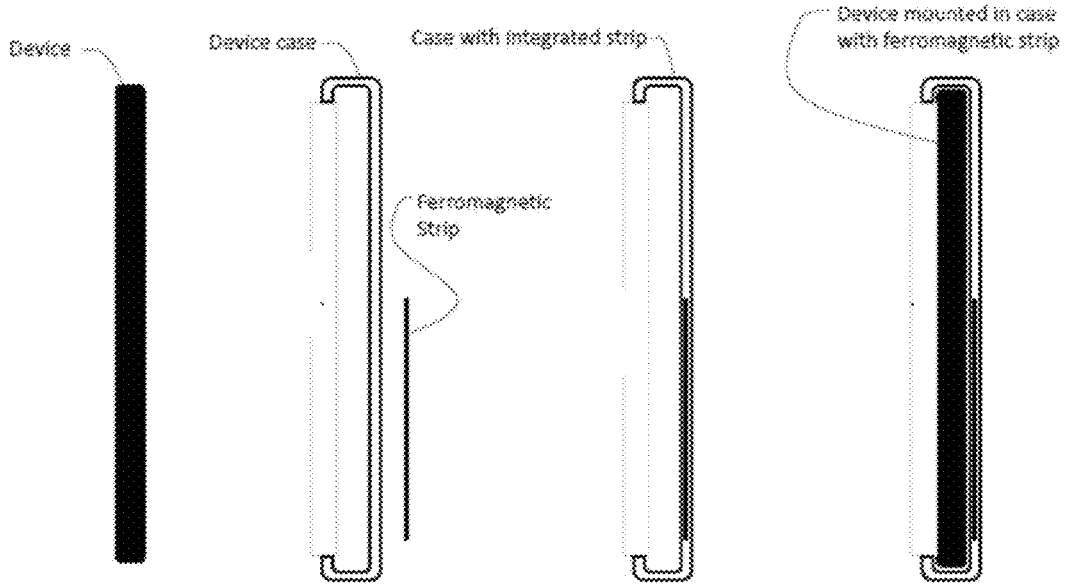
FIGS. 68A-68D shows versions of a device and case assembly with ferromagnetic strip incorporated into the device case, according to exemplary embodiments of the invention.
Figures 69A, 69B, 69C, 69D:
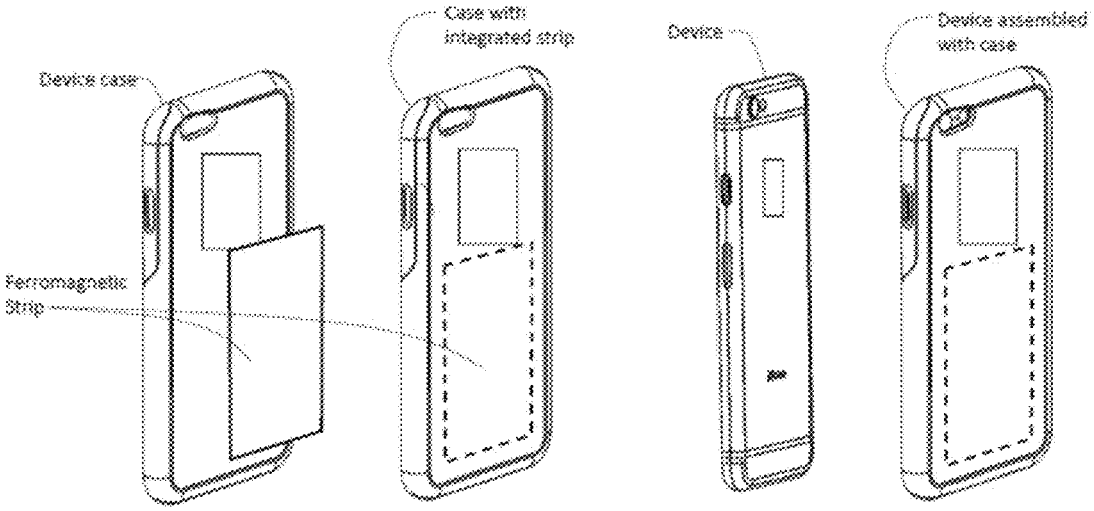
FIGS. 69A-69D shows versions of a device and case assembly with ferromagnetic strip incorporated into the device case, according to exemplary embodiments of the invention.

FIGS. 63-64 show oblique rear and upper view of an electric guitar equipped with a metal neck attachment plate on its back side, where a mounting bracket equipped with magnet arrays at its opposite ends attaches to the guitar with one magnet array and to a mounted device with the other magnet array.

The above provides for an almost infinite number of options, including; a mechanical interface device between electronic device and curved surface of a guitar allowing stable attachment between device flat surface and guitar curved surface. A rigid block with flat surface opposite concave surface including soft deformable block with one rigid surface, for example, silicone or bean-bag. Rigid device attachment surface, rigid guitar-attachment surface, at least one non-"sticky" surfaces, at least one surface "sticky" and/or both surfaces "sticky". A soft deformable block incorporating at least one ferromagnetic element, deformable device attachment surface, deformable guitar-attachment surface or both sides deformable. Non-"sticky" surfaces, one surface "sticky", both surfaces "sticky". Surfaces that contain at least one ferromagnetic element, contains at least one magnet, contains patterned array of magnets. Similarly, the magnet array is rigid, magnet array is flexible, magnet array contains adjacent magnets with aligned polarities and/or magnet array contains adjacent magnets with alternating polarities. Magnet arrays with separated/separable magnets, magnet array with touching magnets and/or rectilinear arrays as well as Non-rectilinear arrays.

Magnet array size changeable for different desired magnetic strengths, device with at least one linear concave side surface to allow easier grasping, device with at least one convex surface to allow easier grasping, device has at least one non-marring surface, device includes at least one piece of wood, device including at least two pieces of wood with non-aligned grain patterns, device incorporating at least one battery. Where the battery is removable, and/or battery is rechargeable, device incorporating at least one magnetic induction coil, device capable of simultaneously attracting two ferromagnetic strips on opposite sides, device capable of simultaneously attracting a ferromagnetic strip attached to an external device on one side and another ferromagnetic strip attached to the inner surface of a guitar, ferromagnetic strip removably attached to the inner surface of a guitar, strip capable of conforming to the curvature of the inner surface of a guitar, strip comprised of multiple attached ferromagnetic element. In addition, magnetic induction coil removably attached to the inner surface of a guitar, capable of being mounted opposite an attached electronic device, capable of supplying electric power to an attached electronic device.

Figure 70:
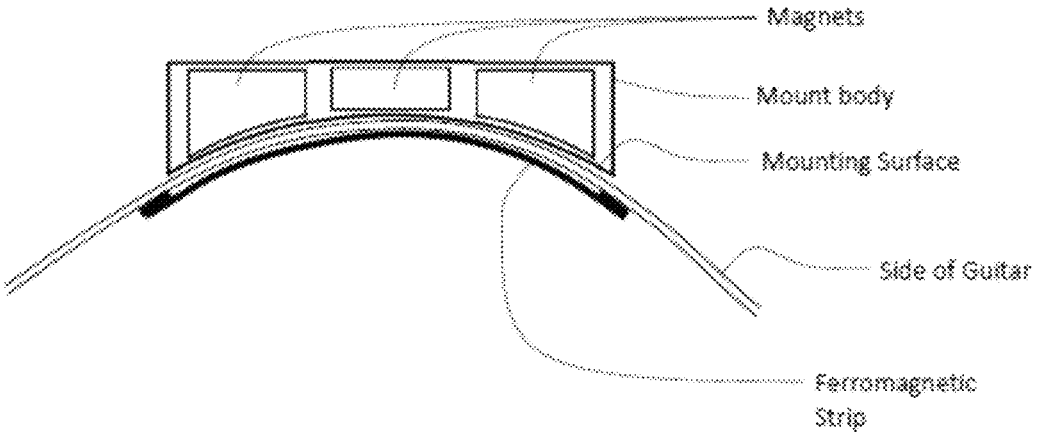
FIG. 70 shows a magnetic mount with magnets shaped to conform with mounting surface, according to exemplary embodiments of the invention.

Referring to FIGS. 68A-D and FIGS. 69A-69D we see an embodiment that points to the importance of minimizing the distance between the magnets and the steel shims in both the phone case and inside the guitar. Adding 2 mm of thickness cuts the attractive force by half. So embedding the phone shim in a custom case would help pick up a half mm or so. Similarly, designing the frog so that the magnets are as close to the flat and curved contact surfaces as possible is of great importance. FIG. 70 illustrates magnets shaped to conform to joining surface.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. A removable magnetic attachment mechanism for attaching at least one device to the external surface of a musical instrument such as a guitar, whereby said attachment mechanism comprises;

a magnetically attractive element device attachment mechanism using magnetic attractive force to simultaneously attract at least one magnetically attractive element comprised of at least one magnet, wherein said magnetically attractive element has at least one non-marring surface where it makes contact with the outer surface finish of the musical instrument; and a first ferromagnetic strip configured to be removably attached at one or more points along an axial direction of a strip attachment material mounted to the inner surface of said musical instrument.

2. The magnetic attachment mechanism of claim 1 further comprising;

a second ferromagnetic strip configured to allow attachment to said magnetically attractive element surface;

wherein said strip of material mounted inside said musical instrument is comprised of hooks-and-loops; and said first ferromagnetic strip has a complementary portion of hooks-and-loops material permanently attached to said first ferromagnetic strip's surface.

3. The magnetic attachment mechanism of claim 2 wherein;

said magnetically attractive element has at least one surface curved to approximately match at least one curved surface on said instrument's surface.

4. The magnetic attachment mechanism of claim 3 wherein;

said magnetically attractive element has at least one magnet shaped to match the curve of said device curved surface.

5. The magnetic attachment mechanism of claim 3 wherein;

said magnetically attractive element has at least one deformable pad along at least one said attractive element's surface.

6. The magnetic attachment mechanism of claim 5 wherein;

said second ferromagnetic strip is part of a device case.

7. The magnetic attachment mechanism of claim 2 wherein;

said magnetically attractive element has at least one deformable pad along at least one of said attractive element's surface.

8. The magnetic attachment mechanism of claim 7 wherein;

said second ferromagnetic strip is part of a device case.

9. The magnetic attachment mechanism of claim 3 wherein;

said magnetically attractive element has at least one deformable pad along at least one attractive element surface.

10. The magnetic attachment mechanism of claim 9 wherein;

said second ferromagnetic strip is part of a device case.

11. The magnetic attachment mechanism of claim 1 further comprising;

a second ferromagnetic strip configured to allow attachment to said magnetically attractive element surface;

wherein said strip of material mounted inside said musical instrument is comprised of one or more bendable inner ferromagnetic strip with thickness between 0.1 mm and 2 mm thick allowing it to be shaped by hand to match the curvature of the inner attachment surface.

12. The magnetic attachment mechanism of claim 11 wherein;

said strip of material has a complementary portion of hooks-and-loops material permanently attached to said first ferromagnetic strip's surface.

13. The magnetic attachment mechanism of claim 12 wherein;

said second ferromagnetic strip is part of a device case.

14. The magnetic attachment mechanism of claim 11 wherein;

said strip of material has one or more chemical bonding elements for permanent attached to said instrument's inner surface.

15. The magnetic attachment mechanism of claim 14 wherein;

said second ferromagnetic strip is part of a device case.

* * * * *